US007625053B2

(12) United States Patent
Takanose et al.

(10) Patent No.: US 7,625,053 B2
(45) Date of Patent: Dec. 1, 2009

(54) INK JET RECORDING APPARATUS

(75) Inventors: Tomoka Takanose, Shizuoka-ken (JP); Ryutaro Kusunoki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 173 days.

(21) Appl. No.: 11/389,246

(22) Filed: Mar. 27, 2006

(65) Prior Publication Data

US 2006/0221103 A1 Oct. 5, 2006

(30) Foreign Application Priority Data

Mar. 29, 2005 (JP) ..... 2005-095638

(51) Int. Cl.
*B41J 29/38* (2006.01)

(52) U.S. Cl. ..... 347/6; 347/9; 347/12

(58) Field of Classification Search ..... None
See application file for complete search history.

(56) References Cited

U.S. PATENT DOCUMENTS 5,831,650 A 11/1998 Reiten
6,273,539 B1 8/2001 Suzuki
2003/0122889 A1* 7/2003 Okuda ..... 347/19
2004/0155915 A1 8/2004 Kitami et al.

FOREIGN PATENT DOCUMENTS

EP 1 036 660 B1 9/2000
JP 2004-42414 2/2004
JP 2004-42414 A 2/2004

OTHER PUBLICATIONS

Translation of JP 2004-042414.*
U.S. Appl. No. 11/357,091, filed Feb. 21, 2006, Kusunoki et al.
U.S. Appl. No. 11/353,980, filed Feb. 21, 2006, Kusunoki et al.
European Search Report dated Feb. 23, 2007.

* cited by examiner

*Primary Examiner*—Matthew Luu
*Assistant Examiner*—Justin Seo
(74) *Attorney, Agent, or Firm*—Pillsbury Winthrop Shaw Pittman, LLP

(57) ABSTRACT

An ink jet recording apparatus comprises an ink jet recording head in which a volume of a pressure chamber is caused to vary by deflecting actuators according to drive signals applied between an electrode formed in a pressure chamber (9*c*) from which ink is to be ejected and electrodes formed in two pressure chambers adjacent the former, and a drive signal generator that generates drive signals for driving the recording head in the time-divisional drive method. The drive signals are applied to electrodes formed in pressure chambers 9*a*, 9*b*, 9*d*, and 9*e*, from which ink is not to be ejected so that pressure vibrations derivatively generated in the adjacent pressure chambers 9*b* and 9*d* are evenly dispersed to the pressure chambers 9*a*, 9*b*, 9*d*, and 9*e*. Thus, dropping of velocities of ink droplets that are subsequently ejected can be prevented and thereby printing quality can be improved.

12 Claims, 30 Drawing Sheets

INK JET RECORDING APPARATUS

CROSS REFERENCE OF THE INVENTION

This application is based upon and claims the benefit of priority from the prior Japanese Patent Application No. 2005-095638 filed on Mar. 29, 2005, the contents of which are incorporated herein by reference.

BACKGROUND OF THE INVENTION

1) Field of the Invention

The present invention relates to an ink jet recording apparatus that ejects ink and records an image on a recording medium, particularly to an ink jet recording apparatus that ejects ink droplets from a nozzle communicating with a pressure chamber by driving actuators of sidewalls partitioning the respective pressure chambers to cause the actuators to deflect so as to vary a volume of the pressure chamber.

2) Description of the Related Art

Among ink jet recording heads with which ink is ejected from a nozzle by deflecting an actuator or actuators according to a drive signal to vary the capacity of its pressure chamber, there is a shared wall type inkjet recording head in which a partition wall (sidewall) between pressure chambers serves as an actuator. In this type of recording head a time-divisional driving method is employed so that pressure chambers adjacent each other are not driven concurrently. That is, this time-divisional driving is operated such that a plurality of pressure chambers in the recording head are divided into two, three, or more groups so that neighboring pressure chambers can be driven separately at different timings from each other for ink to be ejected therefrom.

In this type of recording heads it is known that, when one pressure chamber is driven to generate a pressure vibration so as to eject ink therefrom, neighboring pressure chambers are affected so that a pressure vibration having an amplitude of half that of a pressure vibration generated in the ink-ejecting pressure chamber is derivatively produced at the same time within each of the neighboring chambers and thereby a meniscus in the respective nozzles adjacent a nozzle from which ink is ejected protrudes from the surface of the nozzle. This phenomenon remarkably appears in so-called multi-drop gradation recording in which a group of plural ink droplets that form one pixel are consecutively ejected. If the operation continues in the state as occurred in this time-divisional driving to eject ink from one of the nozzles, from the surfaces of which meniscuses protrude, a velocity of an ink droplet that is ejected from the nozzle largely drops. This results in degradation of over all recording quality.

One solution to the above problem is proposed, for example, in Japanese patent application No. 2004-42414, that in four time-divisional driving of the recording head, meniscus protrusions in nozzles occurring at successive timings of ink ejection can be suppressed by reducing amplitudes of pressure vibrations within the pressure chambers driven at the successive timings down to one forth that of pressure vibration within the ink-ejecting pressure chamber such that, when actuators associated with one selected pressure chamber are driven to eject ink therefrom, actuators relative to the respective pressure chambers adjacent the selected one, the actuators opposing ones shared by the selected chamber and one neighboring it, are also driven so as to deflect in the same respective directions as actuators, on the both sides of, driving the selected pressure chamber to deflect.

However, in the structure described in the specification, where ink ejection continues over one printing period, for example, in the case that after completion of one cycle of ink ejection from pressure chambers each being sequentially selected to be driven in one cycle of four time-divisional driving, the operation of ink ejection continues restarting from the pressure chamber assigned at the first timing division where a protrusion having occurred at the first ink ejection in the previous cycle remains as being insufficiently suppressed, the velocity of the second droplet ejected from the same pressure chamber drops significantly. This causes a problem that droplet landing positions become inconsistent.

SUMMARY OF THE INVENTION

In view of the problems described above, the present invention provides an ink jet recording apparatus which, where operation of ink ejection is continuously performed over one printing cycle, protrusions of ink meniscuses after the first ink ejection can be sufficiently suppressed and thereby dropping of velocities of ink droplets at the second ink ejection cycle can be controlled by suppressing peaks of pressure in pressure chambers of a group at timing of no ink ejection. Thus, recording quality can be improved.

An object of the present invention is to provide an inkjet recording Apparatus which comprises: an ink jet recording head having a plurality of nozzles from each of which ink is ejected, a plurality of pressure chambers communicating with the respective nozzles, ink supplying means for supplying ink to the respective pressure chambers, a plurality of electrodes provided relative to the respective pressure chambers, and actuators each of which forms a side wall isolating the respective pressure chambers and is driven to deflect so as to vary a volume of the pressure chamber according to drive signals; and drive signal generating means for supplying the drive signals driving the pressure chambers to the electrodes relative to the respective pressure chambers, wherein said drive signal generating means generates drive signals for causing one of N serially arranged pressure chambers to eject ink therefrom, and for substantially evenly varying volumes of the remainder of the N pressure chambers, N being four or more.

DESCRIPTION OF THE PREFERRED EMBODIMENTS

One Embodiment

Figure 1:
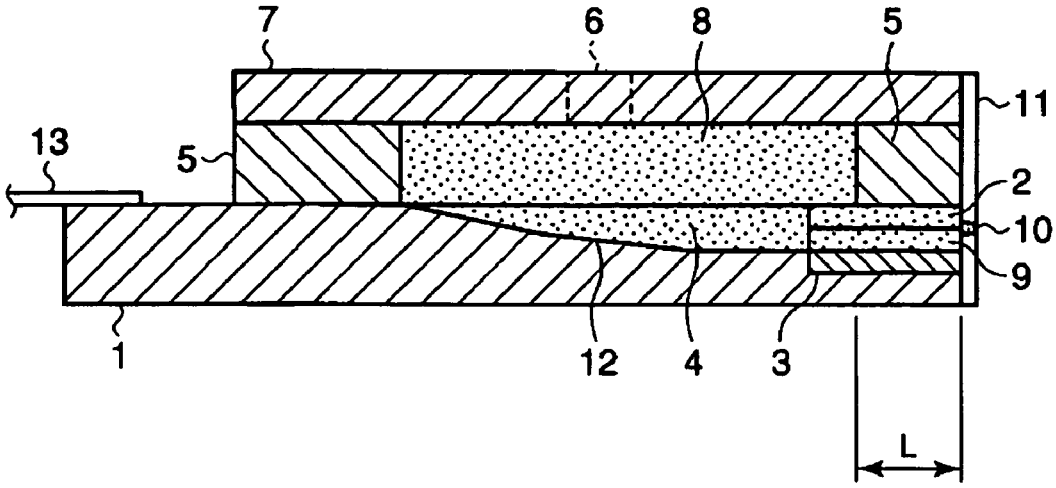
FIG. 1 is a longitudinal cross sectional view showing a whole structure of an ink jet recording head according to the first embodiment of the present invention.

One embodiment according to the present invention will be described in reference to the accompanying drawings, in which like reference numerals indicate like structures.

A structure of an ink jet recording head used in this embodiment is now described. FIG. 1 is a longitudinal cross sectional view illustrating a whole structure of an ink jet recording head. As shown in the FIGURE, in the fore-end of a substrate 1 of a low dielectric constant there are embedded two piezoelectric members being glued together such that the respective polarization directions of two piezoelectric members 2, 3, each of which are polarized in the plate thickness direction, are opposed to each other. In the piezoelectric members 2, 3 embedded in substrate 1 and a portion of substrate 1 in the back of the piezoelectric members 2, 3, a plurality of grooves 4 are formed in parallel spaced from each other at a prescribed interval by cutting. Piezoelectric members 2, 3 partitioning the respective grooves and substrate 1 constitute "sidewalls."

An ink supply path 8 from which ink is supplied into the grooves is formed by adhering a top plate frame 5 and top plate lid 7 having ink supply port 6 onto substrate 1. A nozzle plate 11 in which nozzles 10 for ejecting an ink droplet are formed is fixed by gluing to the forefronts where top plate lid 7, top plate frame 5, piezoelectric members 2, 3, and substrate 1 conjoin. An electrode 12 that drives piezoelectric members 2, 3 is formed electrically independently from each other within the interior wall of the groove and extends to an upper surface of substrate 1. The respective electrodes are connected to a drive circuit (later described) that is provided on a circuit board 13.

The piezoelectric member forming the sidewall 2, 3 serves as an actuator, which deflects by a voltage applied between two electrodes sandwiching the actuator. A room defined by top plate frame 5 on the front and a portion of the grooves at a length L forms a pressure chamber 9 for ejecting ink.

The grooves are formed at desired dimensions of depth, width, and length by cutting substrate 1 and piezoelectric members 2 and 3 as specified by a disc diamond cutter. The electrodes are formed such that, after the rest of the groove and substrate 1 other than a portion to be plated is masked by a resist beforehand and wholly electroless-plated, the mask is peeled off the groove surface. Alternatively, after forming a film with an electrode material by a spattering or vacuum deposition process on the surface, a desired pattern of electrode can be shaped up by etching.

Figure 2:
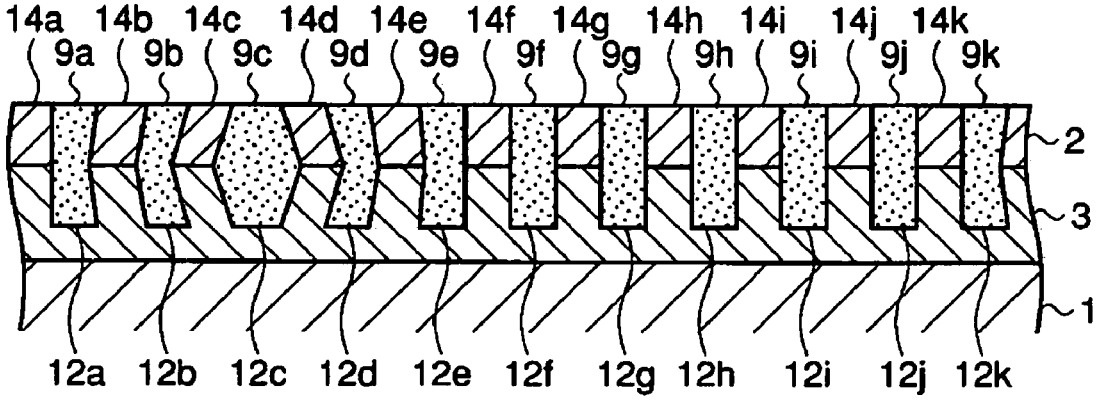
FIG. 2 is a transverse cross sectional view for illustrating operation of actuators in the ink jet recording head according to the first embodiment.

FIG. 2 is a transverse sectional view illustrating a structure of the fore end of the ink jet recording head. Operation of the ink jet recording head will now be described in reference to this FIGURE. In the FIGURE, reference numerals 9*a*-9*k* denote pressure chambers; 12*a*-12*k* denote electrodes formed within pressure chambers 9*a*-9*k*; 14*a*-14*jk* denote actuators consisting of respective piezoelectric members 2 and 3 that are formed as sidewalls between the respective pressure chambers.

Now, how an ink droplet is ejected from pressure chamber 9*c* will be described as in the case that the ink jet recording head is driven in the time-division driving operational method. Description hereafter will be made as nozzles 10*a*-10*k* communicating with pressure chambers 9*a*-9*k*, respectively.

Ink supplied into the ink jet recording head from ink supply port 6 is filled in pressure chamber 9 through ink supply path 8. When a potential difference is applied between the electrodes 12*c* and 12*b*, and 12*c* and 12*d* at the same time by drive signals, which will be described later, actuators 14*c* and 14*d* are caused to deflect in the shear mode thereby varying a volume of pressure chamber 9*c* so that an ink droplet is ejected from nozzle 10*c*. Similarly, when a potential difference is applied between the electrodes 12*g* and 12*f*, and concurrently 12*g* and 12*h*, actuators 14*g* and 14*f* are caused to deflect in the shear mode thereby varying a volume of pressure chamber 9*g* so that an ink droplet is ejected from nozzle 10*g*.

This ink jet recording head is a so-called shared wall type recoding head, in which one actuator 14 is shared by two pressure chambers 9 that neighbor to it on the both sides. Because one actuator is shared by two pressure chambers, mutually neighboring two pressure chambers 9 cannot be concurrently operated. For this reason, in this recording head the time divisional driving method is employed, in which pressure chambers of every predetermined numbers are driven so as to be able to eject inks concurrently therefrom while preventing neighboring pressure chambers 9 from operating at the same timing. In other words, printing control is made such that signals that drive every N pressure chambers from which inks are made to be ejected concurrently are applied to the electrodes provided within the respective pressure chambers. Herein, the operation is illustrated, by way of example, in five time-divisional drive method.

Furthermore, for example, in the case where ink is made to be ejected from pressure chamber 9*c*, voltages are imparted also between electrodes 12*a* and 12*b*, and between 12*d* and 12*e*, whereby actuators 14*b* and 14*e* are driven to deflect so that pressure vibrations of ink produced within pressure chambers 9*b* and 9*d* can be deconcentrated towards pressure chambers 9*a* and 9*e*.

In this manner, by deconcentrating pressure vibration of ink produced within a pressure chamber that is not intended to cause ink ejection towards others, amplitude of a meniscus vibration at the non-ink-ejecting nozzle can be reduced. As a result, meniscus protruding from a surface of a non-ink-ejecting nozzle caused by the subsequent meniscus vibration can be suppressed. This effects reduction in terms of variation of meniscus positions and ejection velocities of ink droplets, thus improving recording quality.

Next, the drive signal generator that generates a signal to drive the ink jet recoding head will be described.

Figure 3:
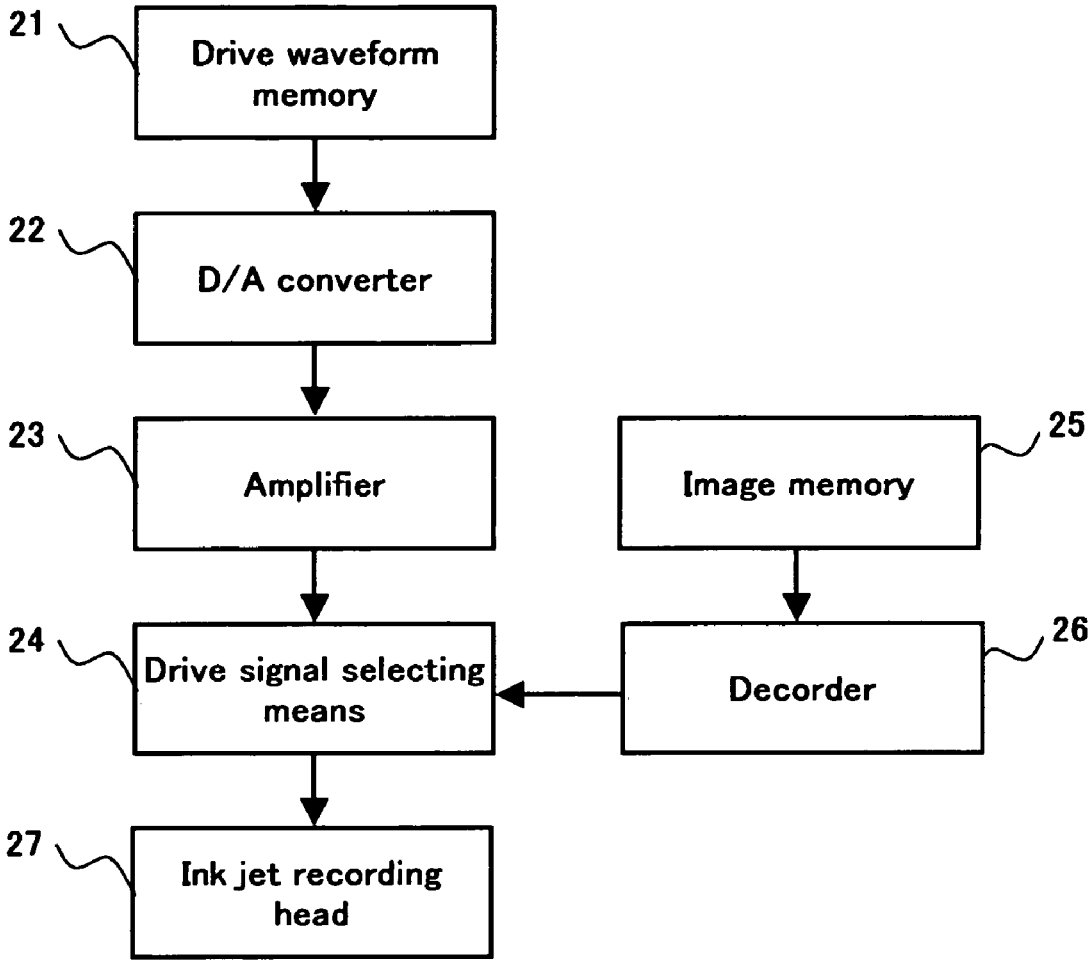
FIG. 3 is a block diagram illustrating a structure of a drive circuit for driving the ink jet recording head according to the first embodiment.

As shown in FIG. 3, the drive signal generator is constituted by a drive waveform memory 21, D/A converter 22, amplifier 23, drive signal selecting means 24, image memory 25, and decoder 26. Drive waveform memory 21 memorizes information on waveforms of drive signals ACT1-ACT 5 that are applied to pressure chambers 9 causing ink to be ejected, and information on waveforms of drive signals INA that is applied to pressure chambers 9 not causing ink to be ejected. D/A converter 22 receives information on waveforms of drive signals ACT1-ACT 5 and INA, and converts the waveform information into analog signals. Amplifier 23 amplifies these drive signals ACT1-ACT 5 and INA now converted into analog signals, and outputs them to drive signal selecting means 24. The drive signals are selected through decoder 26 based on information on gradation of each pixel in an image memorized in image memory 25. Decoder 26 generates ON/OFF signals that determines ejection or non-ejection of an ink droplet according to the gradation information of each pixel in an image memorized in image memory 25, and output the ON/OFF signals to drive signal selecting means 24. Drive signal selecting means 24 selects a drive signal from drive signals ACT1-ACT 5 and INA according to the ON/OFF signals, and applies it to the ink jet recording head.

In this embodiment, recoding is carried out at gradation of eight levels at maximum per a pixel. That is, this eight level gradation recording is carried out by controlling ejection or non-ejection of three types of ink droplets consisting of a first drop of 6 pico-liter in a volume of an ejected ink droplet, second drop of 12 pico-liter of an ejected ink droplet, and third drop of 24 pico-liter of an ejected ink droplet in the manner shown in Table 1.

TABLE 1

| Gradation Level | First droplet (a volome of 6 pico liters) | Second droplet (a volome of 12 pico liters) | Third droplet (a volome of 24 pico liters) | Total volume of accumulated droplets |
|---|---|---|---|---|
| 0 | OFF | OFF | OFF | 0 pl |
| 1 | ON | OFF | OFF | 6 pl |
| 2 | OFF | ON | OFF | 12 pl |
| 3 | ON | ON | OFF | 18 pl |
| 4 | OFF | OFF | ON | 24 pl |
| 5 | ON | OFF | ON | 30 pl |
| 6 | OFF | ON | ON | 36 pl |
| 7 | ON | ON | ON | 42 pl |

Figure 4:
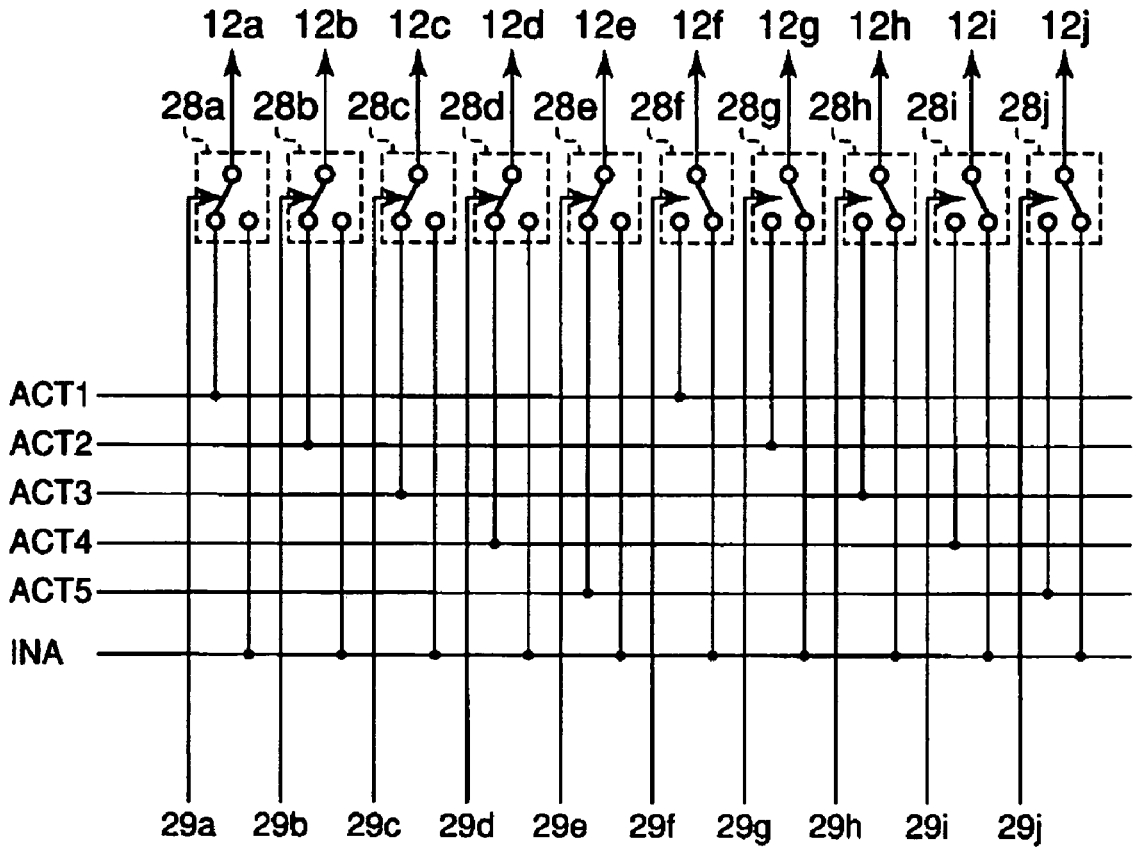
FIG. 4 shows a circuit diagram of the drive signal selecting means indicated according to the first embodiment.

Now, drive signal selecting means 24 will be described. As shown in FIG. 4, drive signal selecting means 24 includes analog switches 28*a*-28*j*, which are operated for On/Off switching according to ON/OFF signals 29*a*-29*j* decoder 26. Although FIG. 4 shows analog switches 28*a*-28*j* corresponding to some of electrodes in the recording head shown in FIG. 2, these switches are actually provided corresponding to electrodes 12 of all the pressure chambers 9 in the recording head.

When ON/OFF signals 29*a*-29*e* are "on," analog switches 28*a*-28*e* select drive signals ACT1-ACT5 that are input from amplifier 23 and lead the signals to electrodes 12*a*-12*e* of ink jet recording head 27, respectively. When ON/OFF signals 29*a*-29*e* are "off," analog switches 28*a*-28*e* select drive signal INA also input from amplifier 23 and lead the signals to electrodes 12*a*-12*e* of ink jet recording head 27, respectively.

When ON/OFF signals 29*f*-29*j* are "on," analog switches 28*f*-28*j* select drive signals ACT1-ACT5 that are input from amplifier 23 and lead the signals to electrodes 12*f*-12*j* of ink jet recording head 27, respectively. When ON/OFF signals 29*f*-29*j* are "off," analog switches 28*f*-28*j* select drive signal INA also input from amplifier 23 and lead the signals to electrodes 12*f*-12*j* of ink jet recording head 27, respectively.

Drive signals ACT1-ACT5 correspond to the first through fifth cycle in five time-divisional driving, respectively. For example, at a certain timing if an ink droplet is desired to be ejected from pressure chamber 9*c* but not from pressure chamber 9*h* which is apart from 9*c* by five positions at the same operation timing, ON/OFF signal 29*c* relative to pressure chamber 9*c* and ON/OFF signals 29*a*, 29*b*, 29*d*, and 29*e*, which relate to two respective positions on the both side of pressure chamber 9*c*, are turned on, while ON/OFF signal 29*h* relative to pressure chamber 9*h* and ON/OFF signals 29*f*, 29*g*, 29*i*, and 29*j*, which relate to two positions on the both side of pressure chamber 9*h*, are turned off.

According to these ON/OFF signals 29*a*-29*j*, drive signals ACT3, ACT1, ACT2, ACT4, and ACT5 are given to pressure chamber 9*c* from which ink is made to be ejected, and 9*a*, 9*b*, 9*d*, and 9*e* on the both sides of pressure chamber 9*c*, respectively, while drive signal INA is given to pressure chamber 9*h* from which ink is made not to be ejected, and 9*f*, 9*g*, 9*i*, and 9*j* on the both side of pressure chamber 9*h*, respectively.

Drive signals ACT1-ACT5 for ejecting ink and drive signal INA for not ejecting ink supplied to drive signal selecting means 24 are now described.

Figure 5:
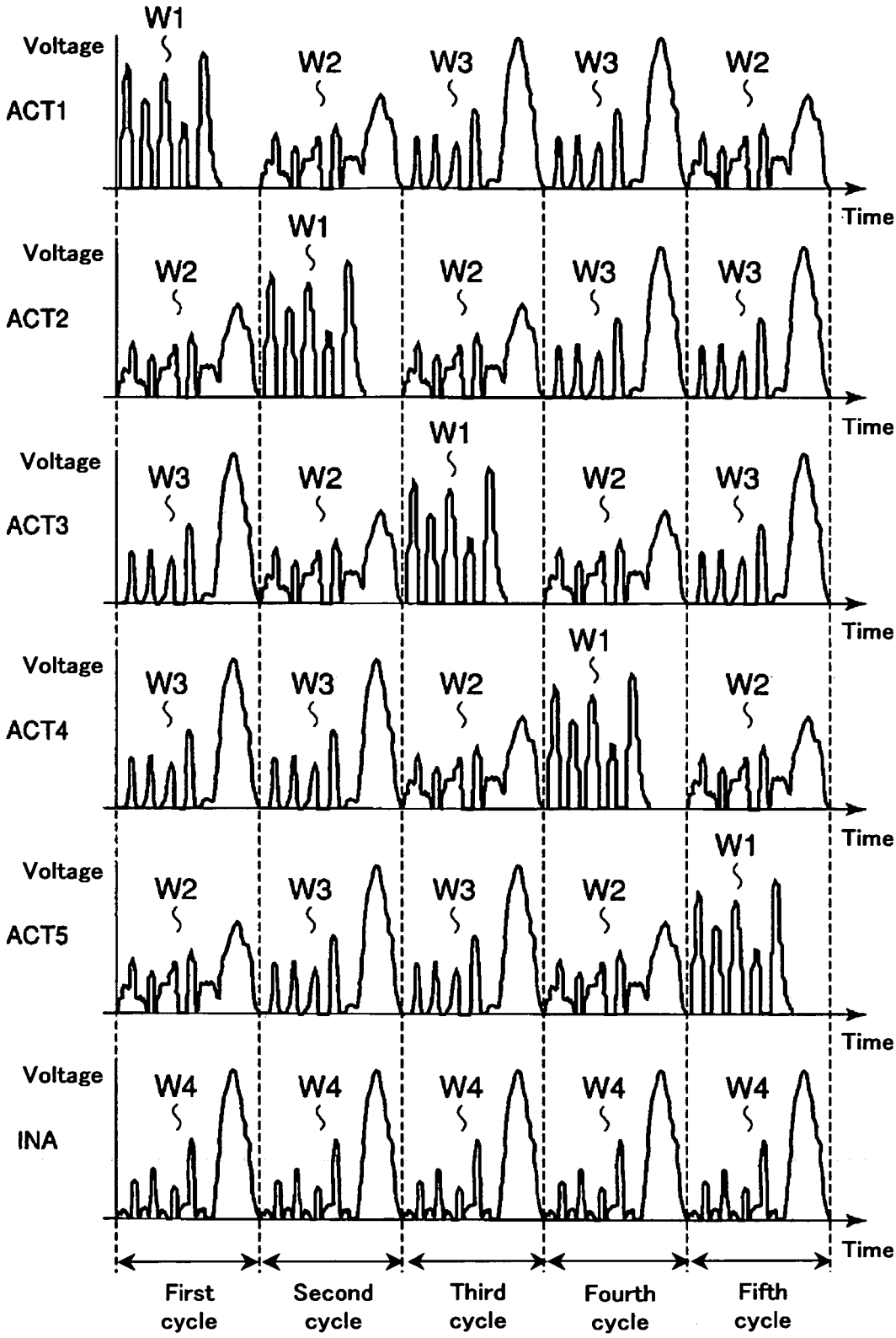
FIG. 5 shows drive signals inputted to the drive signal selecting means according to the first embodiment.

In FIG. 5, drive signals ACT1-ACT5 and INA in one printing period each consisting of five cycles are displayed. The respective drive signals ACT1-ACT5 include three different types of drive signals W1, W2, and W3, while drive signal INA is constituted by drive signal W4. Drive signal W1 is one that is applied to electrode 12 relative to pressure chamber 9 from which an ink droplet is to be ejected.

The respective drive signals ACT1-ACT5 differ in "phase" from one to another by a division cycle. For example, when pressure chamber 9*c* in FIG. 2 is desired to eject an ink droplet, this pressure chamber 9*c* is operated in the third cycle. In this third cycle, first, by activating ON/OFF signals 29*a*-29*e*, drive signal W3 is applied to electrodes 12*a*, 12*e* relative to pressure chambers 9*a*, 9*e*, respectively, drive signal W2 is applied to electrodes 12*b* and 12*d* relative to pressure chambers 9*b* and 9*d*, respectively; and drive signal W1 is applied to electrode 12*c* relative to pressure chambers 9*c*.

Figure 6:
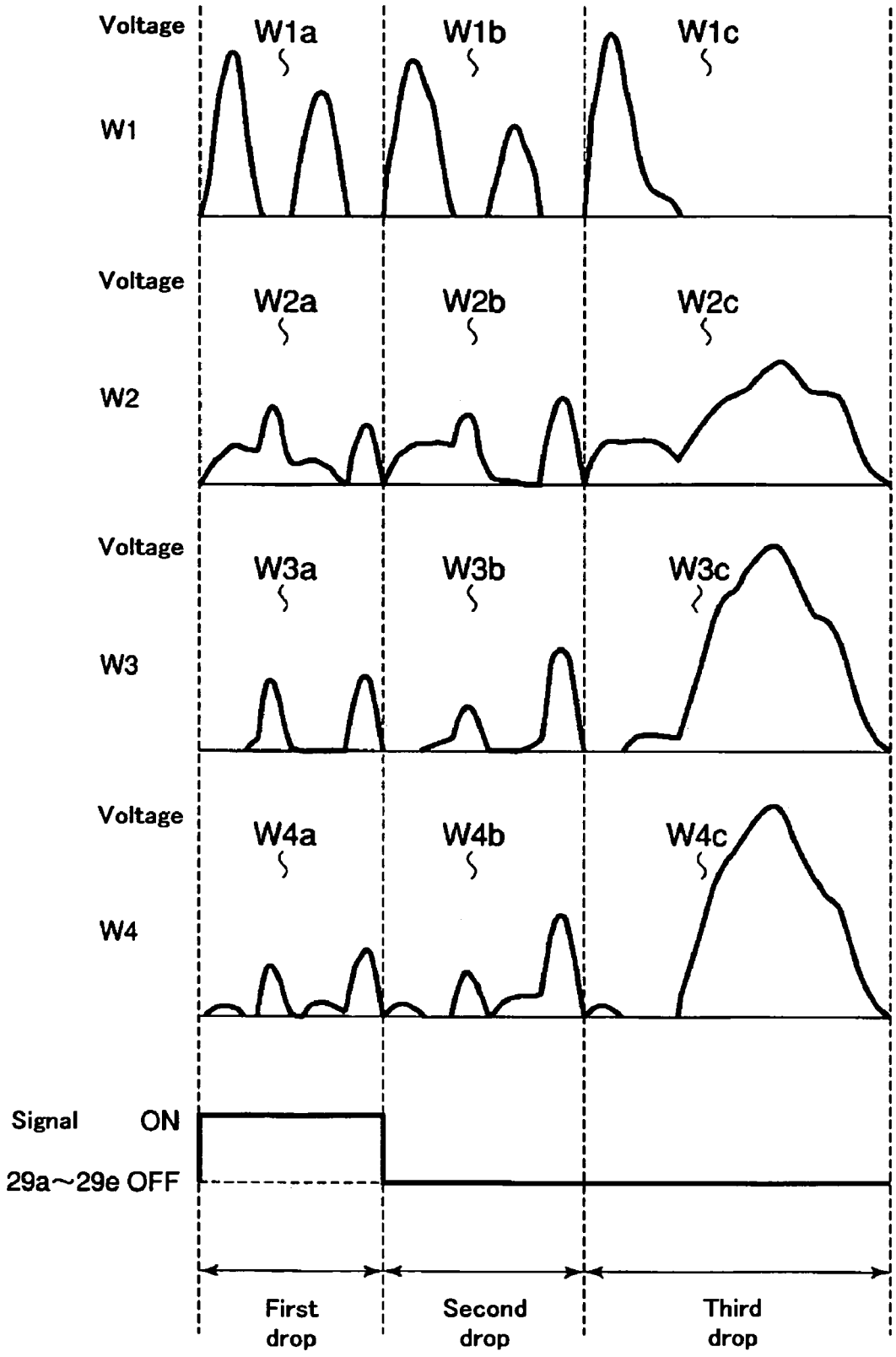
FIG. 6 illustrates individual drive signals that constitute the drive signals inputted to the drive signal selecting means according to the first embodiment.

Next, drive signals W1 through W4 will be described. As shown in FIG. 6, drive signals W1, W2, W3, and W4 are constituted by drive signals W1*a*, W2*a*, W3*a*, and W4*a*, respectively, all of which are disposed at the stage where ejection of the first drop having a volume of 6 pico-liters takes place; by W1*b*, W2*b*, W3*b*, and W4*b*, respectively, all residing at the stage where ejection of the second drop having a volume of 12 pico-liters takes place; and by W1*c*, W2*c*, W3*c*, and W4*c*, respectively, all residing at the stage where ejection of the third drop having a volume of 24 pico-liters takes place.

For example, as shown in FIG. 2, in the case that the first drop is to be ejected from pressure chamber 9*c* but not from 9*h*, ON/OFF signals 29*a*-29*e* are turned on at the first-drop stage within the third cycle in FIG. 5, and ON/OFF signals 29*f*-29*j* are turned off. As a result, drive signal W1*a* is applied to electrode 12*c*, drive signal W2*a* is applied to electrodes 12*b*, 12*d*, drive signal W3*a* is applied to electrodes 12*a*, 12*e*, and drive signal W4*a* is applied to electrodes 12*f*-12*j*.

As a result, actuators 14*c* and 14*d* are largely caused to deflect by a potential difference between drive signals W1*a* and W2*a* so that an ink droplet having a volume of 6 pico liters is ejected from pressure chambers 9*c*. Other actuators 14*b* and 14*e* are caused to deflect by a potential difference between drive signals W2*a* and W3*a* so as to deconcentrate pressure vibrations produced in pressure chambers 9*b* and 9*d* towards pressure chambers 9*a* and 9*e*. A force imparted to actuator 14*f* by a potential difference between drive signals W3*a* and W4*a*, (which are applied to neighboring electrodes 12*e* and 12*f*) works against the deflective motion (in the same actuator 14*f*) accompanied by a pressure having produced within pressure chamber 9*e*. As a result, the actuator 14*f* substantially becomes motionless.

Accordingly, the transmission of the pressure vibration within pressure chamber 9*e*, which has been produced associated with action of ink ejection from pressure chamber 9*c*, to pressure chamber 9*f* via actuator 14*f* is blocked off, and hence cross talk via the actuator can be substantially reduced to a negligible level. Since drive signal W4*a* is commonly applied to electrodes 12*f*, 12*g*, 12*h*, 12*i*, and 12*j* that sandwich the respective actuators 14*g*-14*j*, electric fields are not generated within these actuators. Therefore, actuators 14*g*-14*j* do not deflect and hence no pressure vibrations are produced within pressure chambers 9*f*-9*j*. As a result, no ink is ejected from pressure chamber 9*h*.

Now, how to determine drive signals W1 through W4 will be explained.

Drive signals W1-W4 can be obtained by first defining such meniscus vibrations that are desirable in view of controlling residual pressure vibration, cross talk, gradation performance, and natural vibration of actuators, and then performing inverse operation of such drive signals that induce such vibrations onto the meniscuses using responsive characteristics of vibrating flow velocities of the meniscuses in response to a drive signal in an ink jet recording head. Hereinafter, a "meniscus vibration" defined in order to inverse-calculate a drive signal will be referred to as a "hypothetical meniscus vibration," and a flow velocity of a meniscus merely as a "flow velocity."

Hypothetical meniscus vibration is a meniscus vibration that is linear relative to a drive signal. It is a hypothetical vibration that excludes non-linear components relating to meniscus advancing associated with ink ejection from a nozzle, pull-back of a meniscus occurring immediately after an ink droplet has been ejected from a nozzle, and meniscus advancing associated with an ink refill action by surface tension and other factors, from a meniscus vibration actually produced during operation of ink ejection in an ink jet recording head.

Figure 7:
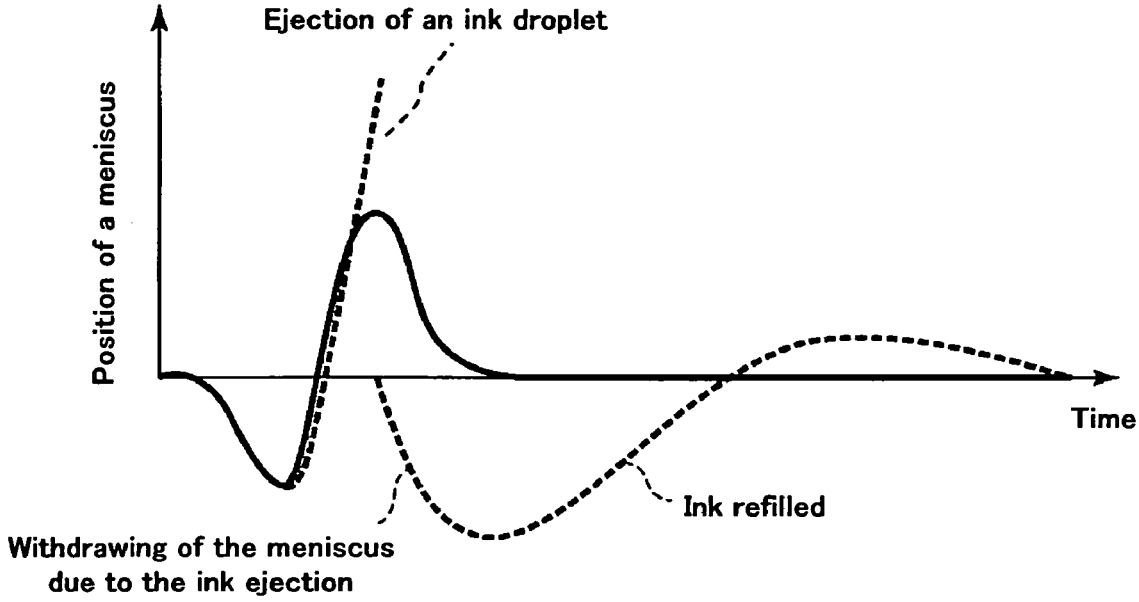
FIG. 7 illustrates a difference between a hypothetical meniscus vibration and an actual meniscus vibration.

The hypothetical meniscus vibration, which is a linear component of a meniscus vibration, can be considered to be an enlarged amplitude of a meniscus vibration produced when a drive signal having an amplitude reduced to a degree insufficient to eject ink is imparted to an ink jet recording head. FIG. 7 illustrates a difference between an actual meniscus vibration and a hypothetical meniscus vibration, wherein a hypothetical meniscus vibration is depicted in a solid line and an actual meniscus vibration in a dashed line.

As shown in FIG. 7, the hypothetical meniscus vibration differs from an actual meniscus vibration generated on ink ejection from a nozzle in an ink jet recording head, but it reflects crucial characteristics linking to behaviors of ink during ink ejection in an ink jet recording head, such as volume and velocity of an ink droplet, residual vibration occurring after an action of ink ejection, cross talk between nozzles, and micro-vibration of a meniscus caused by natural vibration of actuators. Meanwhile, since actual meniscus vibration is affected by the aforementioned non-linear component of a vibration, that is, factors irrelevant to a meniscus vibration caused by a drive signal, controlling an actual meniscus vibration by a drive signal is limited. On the contrary, because the hypothetical meniscus vibration is not affected by factors irrelevant to the meniscus vibration derived from the drive signal, it is very possible to effectively control a meniscus vibration by the drive signal. Thus, by defining a desired hypothetical meniscus vibration and applying a drive signal to actuators so as to cause vibrations, there can be obtained desirable characteristics in respect to a volume and velocity of an ink droplet, residual vibration after action of ink ejection, cross talk between nozzles, and micro-vibration of a meniscus caused by natural vibration of an actuator.

Next, the process of carrying inverse calculation for a drive signal from a hypothetical meniscus vibration will be described. First, a response characteristic R of a vibrating flow velocities in response to a drive signal of the ink jet recording head, which is necessitated for the process of inverse calculation for a drive signal from a hypothetical meniscus vibration is obtained. Then, a drive signal is calculated from the hypothetical meniscus vibration based on the response characteristic obtained.

Figure 8:
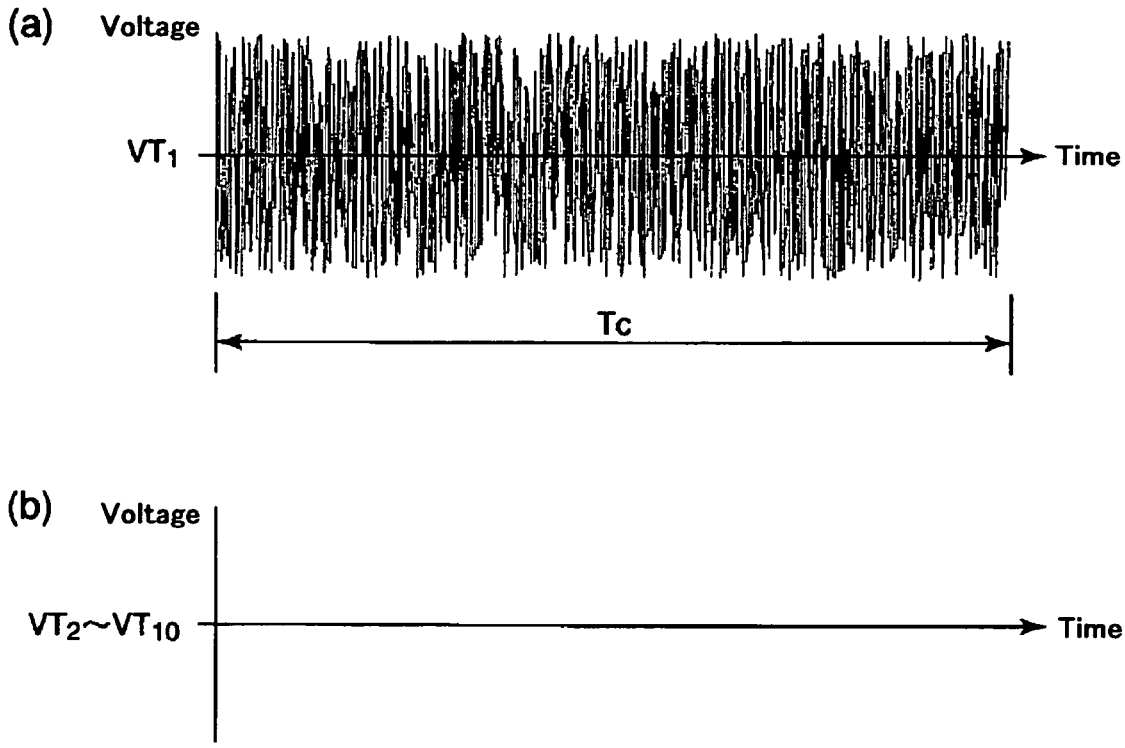
FIG. 8 shows a drive signal used for measuring a frequency response characteristic of the recording head according to the first embodiment.
Figure 9:
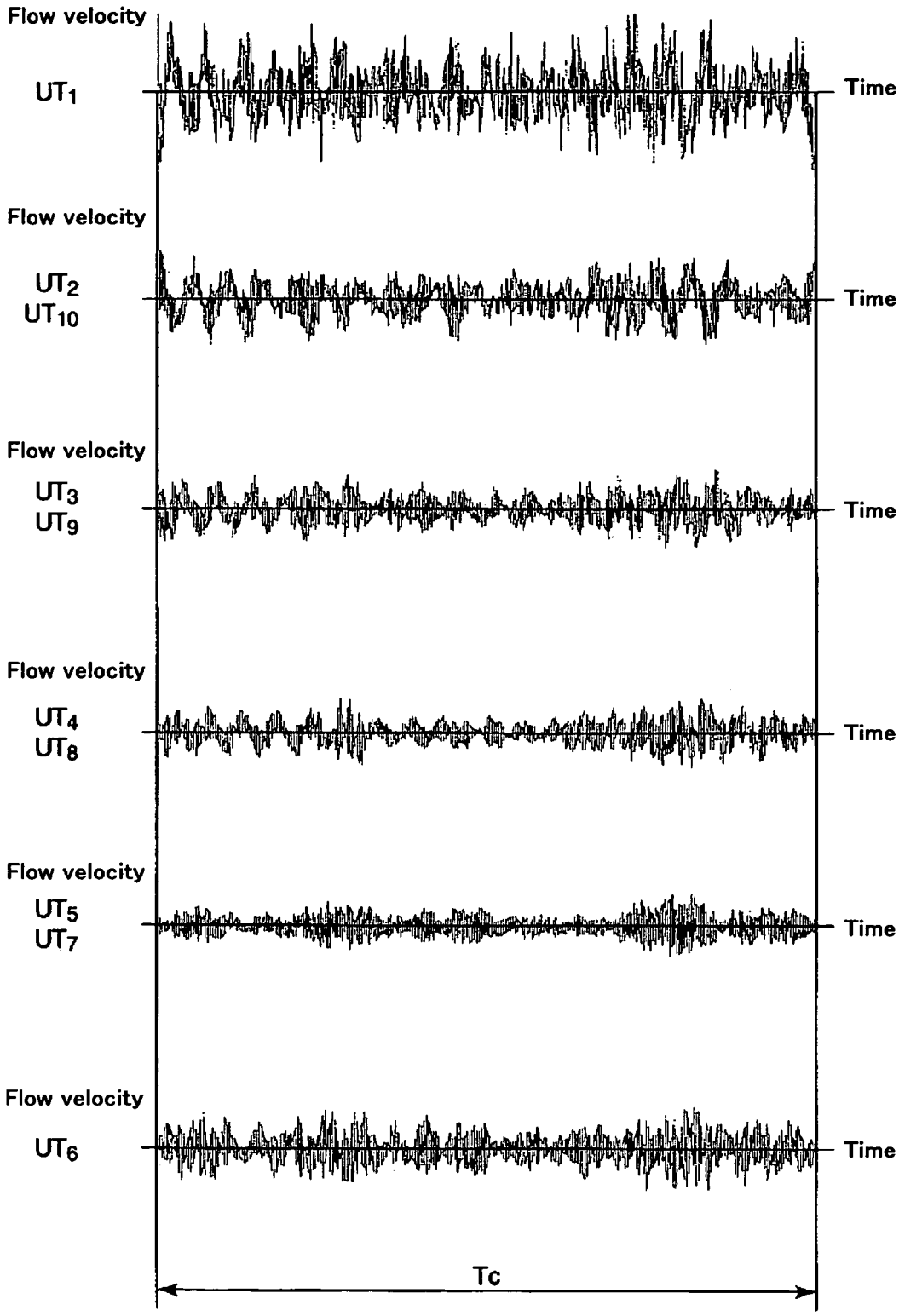
FIG. 9 illustrates vibrating flow velocities of meniscuses in response to the drive signal for measuring a frequency response characteristic of the recording head according to the first embodiment.

The response characteristic R is calculated from a vibrating flow velocity UT within a nozzle responsive to a test drive signal VT. Specifically, test drive signals $VT_1$-$VT_{10}$ are applied to the respective electrodes 12*a*-12*j*. Drive signal $VT_1$ is a waveform of a noise, as seen in FIG. 8, having a period Tc at a voltage sufficiently low enough not to eject an ink droplet, and drive signals $VT_2$-$VT_{10}$ are assumed to be at zero volt. A period Tc is preferably to be set sufficiently longer than an operation time of an ink ejection process. Furthermore, a drive pattern of every 10 channels is applied among a number of pressure chambers by applying to electrode 12*k* the same drive signal $VT_1$ as one to electrode 12*a*. Letting flow velocities of the respective meniscuses produced in nozzles 10*a*-10*j* when the recording head is driven using the above-mentioned drive pattern be $UT_1$-$UT_{10}$, vibrating flow velocities having a period of Tc, as shown in FIG. 9, are produced. The term a "channel" used herein indicates a chamber forming an electrode that communicates with one nozzle. It is used to describe a calculation of the hypothetical meniscus vibration. This vibrating flow velocity can be observed by irradiating a meniscus within a nozzle of the ink jet recording head with a laser beam for measuring, using a laser Doppler vibrometer available in the market, for example, Model LV-1710 of Ono Sokki Co., Ltd.

Subsequently, a voltage spectrum FVT and flow velocity spectrum FUT are transformed by operating Fourier-transformation of the test drive signal VT and vibrating flow velocity UT using the following formulas (1) and (2).

$$FVT_{i,k} = \frac{1}{\sqrt{m}} \cdot \sum_{j=1}^{m} VT_{i,j} \cdot e^{2\pi I(j-1)(k-1)/m} \tag{1}$$

$$FUT_{i,k} = \frac{1}{\sqrt{m}} \cdot \sum_{j=1}^{m} UT_{i,j} \cdot e^{2\pi I(j-1)(k-1)/m} \tag{2}$$

In the above formulas, "m" denotes the number of time-series flow Velocity data observed by the laser Doppler vibrometer. Letting a sampling time for flow velocity data observed by a laser Doppler vibrometer be "dt," "m" is given as a value of Tc/dt. Subscript "i" is an integer denoting a channel number from 1 to 10 and corresponds to the respective electrode of 12*a*-12*j* or nozzle of 10*a*-10*j*. Subscript "j" is an integer from 1 to m denoting "j"th data from the leading in the time-series data array. "j"th data indicates data of "time j×dt." Subscript "k" is an integer from 1 to k denoting "k"th data from the leading in a sequential frequency data array, and "k"th data indicates data of a frequency "(k−1)/Tc." "I" is presented in imaginary unit. Manner of usage of the above subscripts will be applied in subsequent descriptions. $VT_i$, $UT_i$ are time-series data at a time interval of dt having a length of m, and $FVT_i$, $FUT_i$ are sequential frequency data at a frequency interval of 1/(m dt). Voltage spectrum $FVT_{i,k}$ represents a voltage amplitude and a phase of drive signal $VT_i$ at a frequency of (k−1)/Tc in form of a complex number. Also, flow velocity spectrum $FUT_{i,k}$ represents a, flow velocity amplitude and a phase of vibrating flow velocity $UT_i$ at a frequency of (k−1)/Tc in form of a complex number.

Response characteristic R can be obtained from voltage spectrum FVT and flow velocity spectrum FUT in the following formula (3):

$$R_{i,k} = FUT_{i,k}/FVT_{1,k} \tag{3}$$

Figure 10:
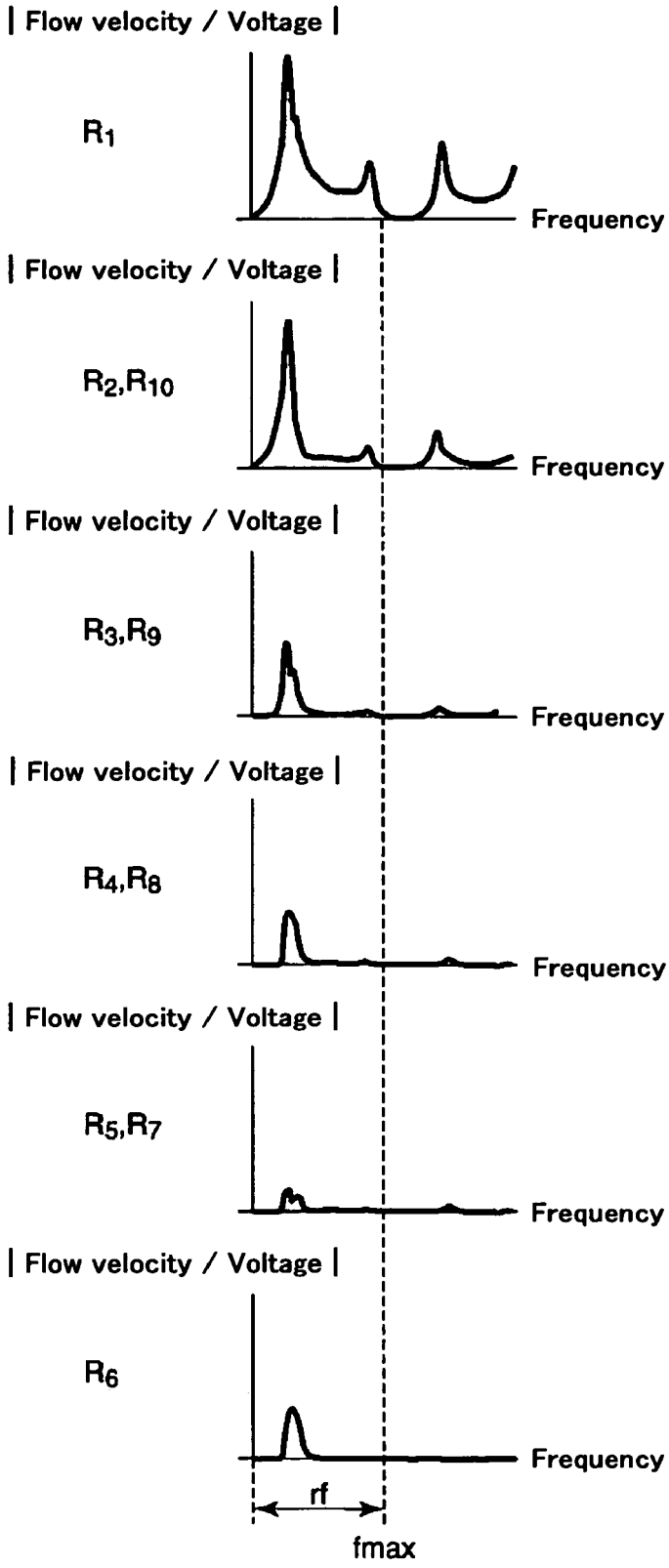
FIG. 10 illustrates response characteristics represented in an absolute value of the recording head according to the first embodiment.
Figure 11:
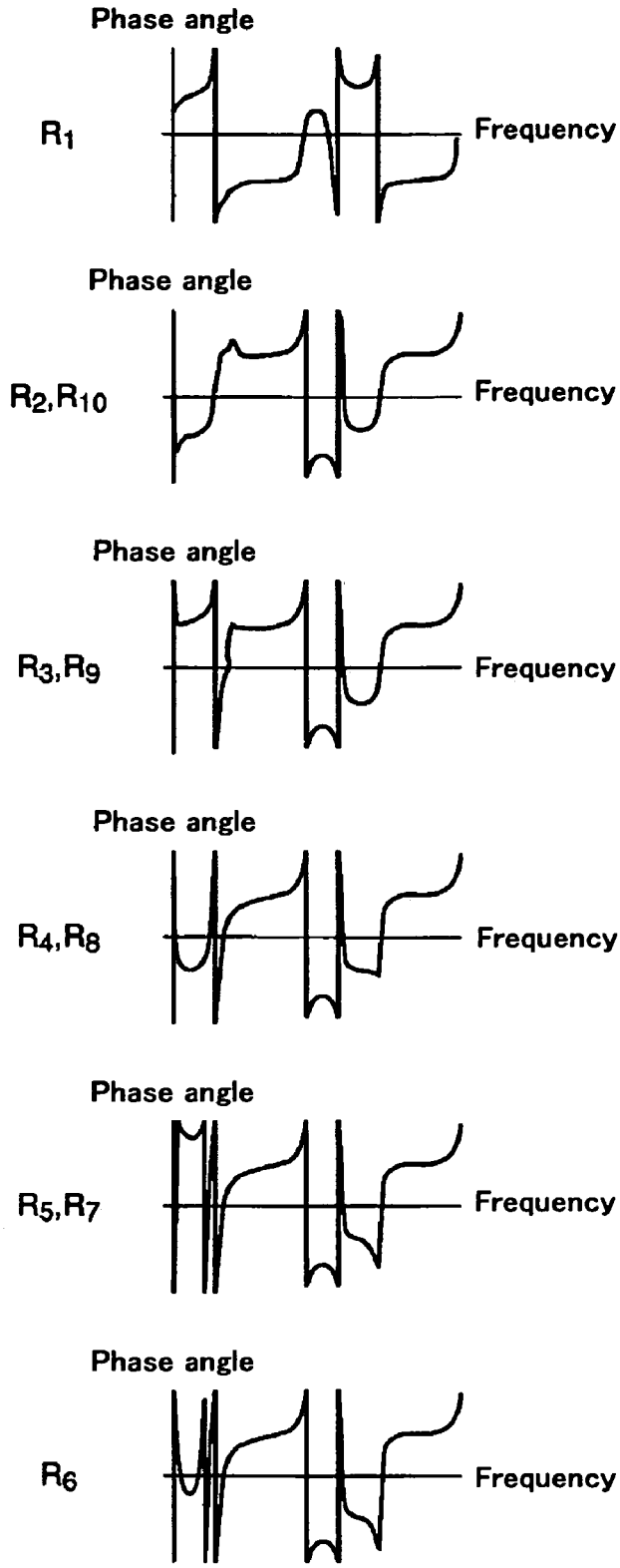
FIG. 11 illustrates response characteristics represented in a phase angle of the recording head according to the first embodiment.

$R_{i,k}$ indicates in form of a complex number a variation of amplitude and phase of flow velocity $UT_i$ of a meniscus within a nozzle at frequency (k−1)/Tc in responsive to drive signal $VT_1$. If response characteristic of each channel is represented by Ri, absolute values and phase angles in $R_1$-$R_{10}$ are shown in FIGS. 10 and 11, respectively. "f max" in FIG. 10 indicates an upper limit frequency in the frequency domain in a range where a meniscus in nozzle 10 can respond to the drive signal continuously from a low frequency part.

The above description has been made for the case where the test drive signal VT used a noise waveform. However, response characteristic R can also be obtained by using sine waves or cosine waves at variable frequencies as the test drive signal and measuring amplitude and phase in vibrating flow velocity of a meniscus in each frequency.

Next, a process of determining the drive signal from a hypothetical meniscus vibration using the response characteristic R obtained in the above will be described.

Figure 12:
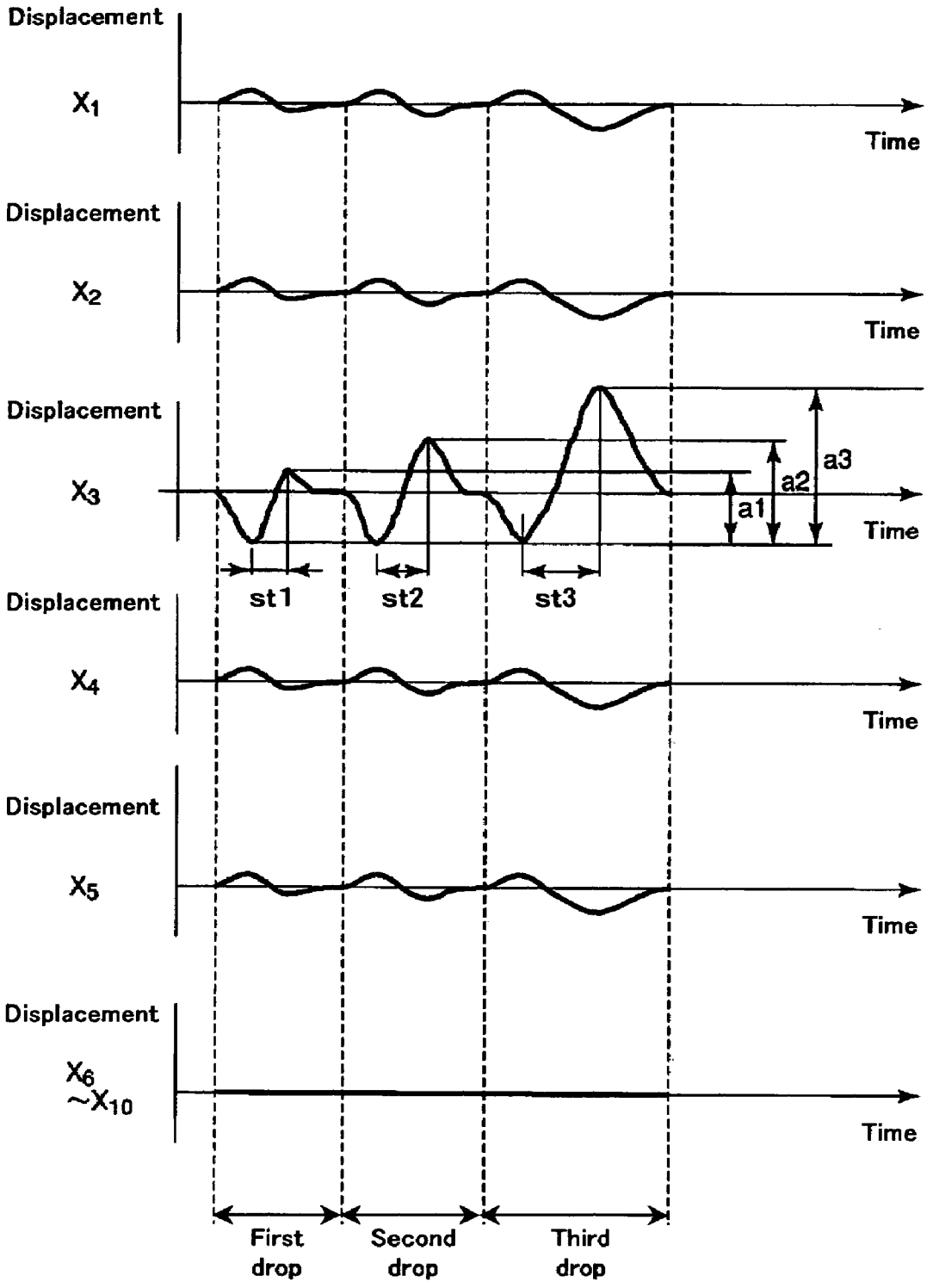
FIG. 12 illustrates an example of a hypothetical meniscus vibrations in the first embodiment.

FIG. 12 illustrates a displacement X of hypothetical meniscus vibration. For example, in the case that the first through third drops are ejected from pressure chamber 9*c* but none from pressure chamber 9*h*, displacements of hypothetical meniscus vibrations in nozzles 10*a*-10*j* are to be $X_1$-$X_{10}$, respectively, as shown. A peak value in the positive domain in each of the hypothetical meniscus displacements in the respective pressure chambers corresponds to a volume of an ink droplet ejected.

Hypothetical meniscus flow velocity $U_i$ relative to a hypothetical meniscus displacement $X_i$ can be obtained, using formula (4) shown below.

$$U_i = d/dt \cdot X_i \tag{4}$$

Figure 13:
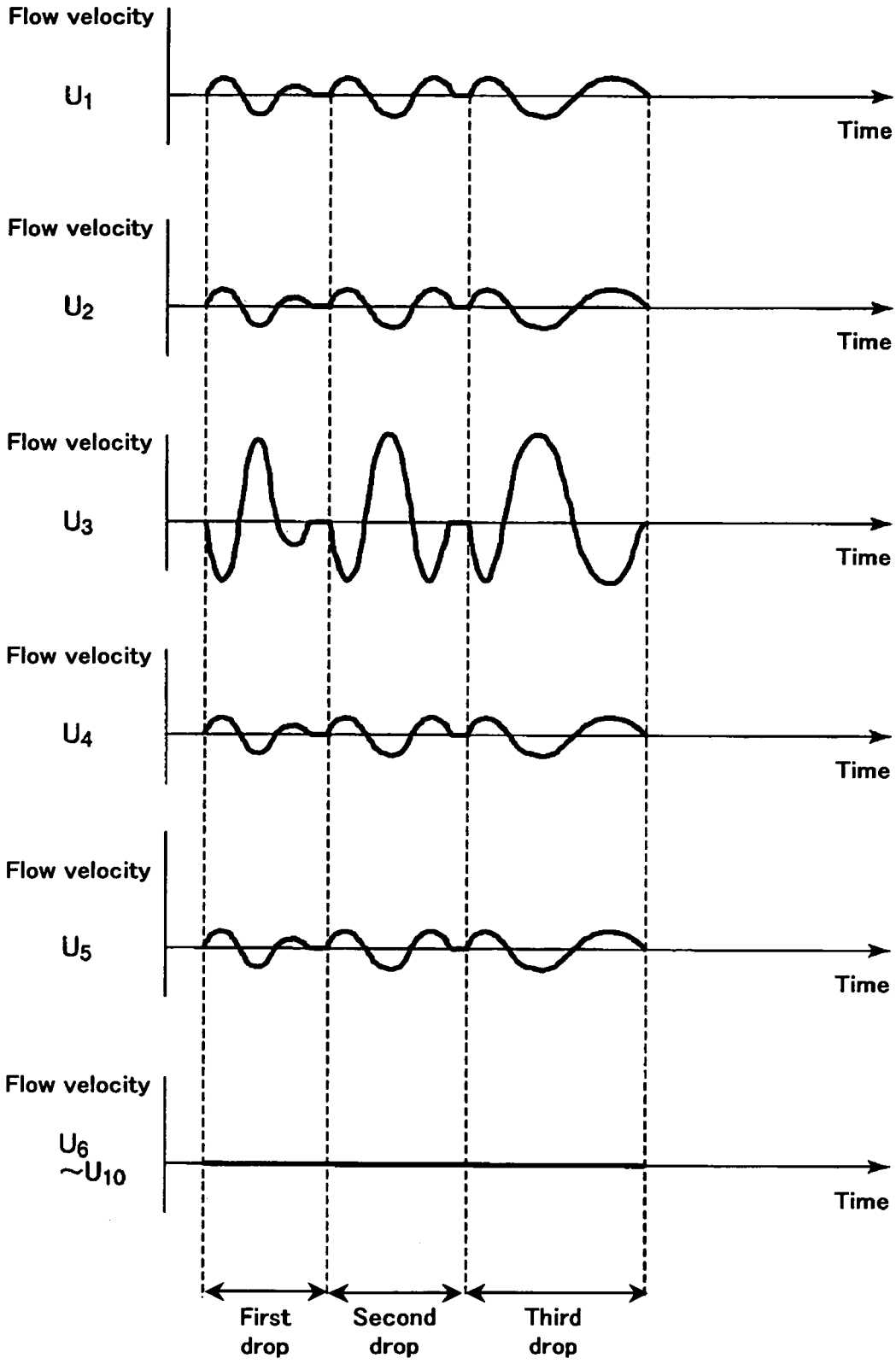
FIG. 13 illustrates flow velocities of a hypothetical meniscus in the first embodiment.

FIG. 13 depicts hypothetical meniscus flow velocities $U_1$-$U_{10}$ obtained using the above formula (4).

Next, flow velocity spectrum FU of hypothetical meniscus flow velocity U will be obtained by computing the Fourier transform of hypothetical meniscus flow velocity U using formula (5) shown below.

$$FU_{i,k} = \frac{1}{\sqrt{m}} \cdot \sum_{j=1}^{m} U_{i,j} \cdot e^{2\pi I(j-1)(k-1)/m} \tag{5}$$

Figure 14:
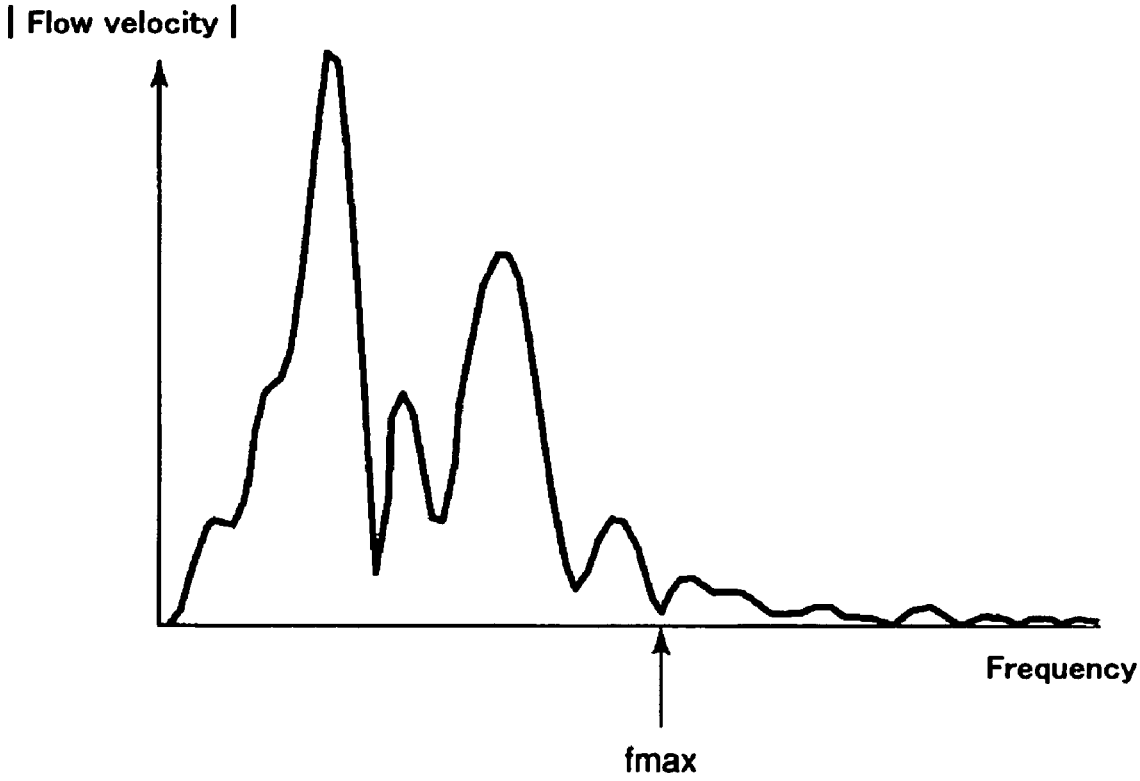
FIG. 14 illustrates a frequency response characteristic of a hypothetical meniscus in the first embodiment.

In the above formula, $U_i$ represents time-series data at time interval dt and length m, and $U_{i,j}$ represents "i"th data from the head data of $U_i$. Flow velocity spectrum $FU_{i,k}$ represents amplitude and phase of the flow velocity in the hypothetical meniscus flow velocity $U_i$ at a frequency (k−1)/Tc in form of a complex number. FIG. 14 depicts $FU_3$ in an absolute value in flow velocity spectrum FU values thus obtained. It is preferable that most part of the frequency component in flow velocity spectrum FU is contained in a range lower than a frequency f max abovementioned as shown in FIG. 14.

Next, voltage spectrum FVA of the drive signal will be obtained from response characteristic R of the ink jet recording head and flow velocity spectrum FU of the hypothetical meniscus vibration. If response characteristic matrix $[R]_k$ is given by formula (6) shown below, voltage vector $\{FVA\}_k$ is given by formula (7) below, and flow velocity vector $\{FU\}_k$ is given by formula (8) below, a voltage vector $FVA_k$ at a frequency (k−1)/Tc can be obtained formula (9) shown below.

$$[R]_k = \begin{bmatrix} R_{1,k} & R_{10,k} & \cdots & R_{2,k} \\ R_{2,k} & R_{1,k} & & R_{3,k} \\ \vdots & R_{2,k} & \ddots & \vdots \\ \vdots & \vdots & & R_{10,k} \\ R_{10,k} & R_{9,k} & \cdots & R_{2,k}\, R_{1,k} \end{bmatrix} \tag{6}$$

$$\{FVA\}_k = \begin{bmatrix} FVA_{1,k} \\ FVA_{2,k} \\ \vdots \\ FVA_{10,k} \end{bmatrix} \tag{7}$$

$$\{FU\}_k = \begin{bmatrix} FU_{1,k} \\ FU_{2,k} \\ \vdots \\ FU_{10,k} \end{bmatrix} \tag{8}$$

$$\{FVA\}_k = [R]_k^{-1} \cdot \{FU\}_k \tag{9}$$

Voltage spectrum $FVA_{i,k}$ obtained in formulas (7) and (9) represents in form of a complex number a voltage amplitude and phase of drive signal $VA_i$ at a frequency (k−1)/Tc that produces hypothetical meniscus flow velocity $U_i$. The element in row "a" at column "b" of [R] k obtained in formula (6) represents a variation of amplitude and phase of vibrating flow velocity of a meniscus, in form of a complex number, within a nozzle provided in "a"th channel relating to a voltage vibration in "b"th channel at a frequency (k−1)/Tc. $[R]_k^{-1}$ is an inverse matrix of $[R]_k$. Computation of the inverse matrix can be performed by using mathematical formula analysis software tool "MATHMATICA" provided by WOLFRAM RESEARCH Ltd.

Next, drive signal VA will be calculated. Drive signal VA can be obtained by computing the Fourier inverse transform of voltage spectrum FVA in the following formula (10).

$$VA_{i,j} = \mathrm{Re}\left[\frac{2}{\sqrt{m}} \cdot \sum_{k=1}^{m'} FVA_{i,k} \cdot e^{-2\pi I(k-1)(j-1)/m}\right] \tag{10}$$

Herein, Re[Z] is a function for obtaining a portion of a real number "a" in a complex number z=a+bI. $VA_{i,j}$ represents a voltage of drive signal VA at time j×dt in "i"th channel that produces hypothetical meniscus flow velocity U.

Drive signal $VA_i$ is applied to the recording head as shown in FIG. 1. That is, drive signals $VA_1$-$VA_{10}$ are applied to electrodes 12*a*-12*j*, respectively, so that hypothetical meniscus displacements $X_1$-$X_{10}$ are made to occur on meniscuses in nozzles 10*a*-10*j*.

m' is a largest integer in a value given by m'≦f max·Tc. By thus setting the upper limit frequency of the inverse Fourier transform to f max, the upper limit value in the frequency component of drive signal VA is now determined to be "f max."

Figure 15:
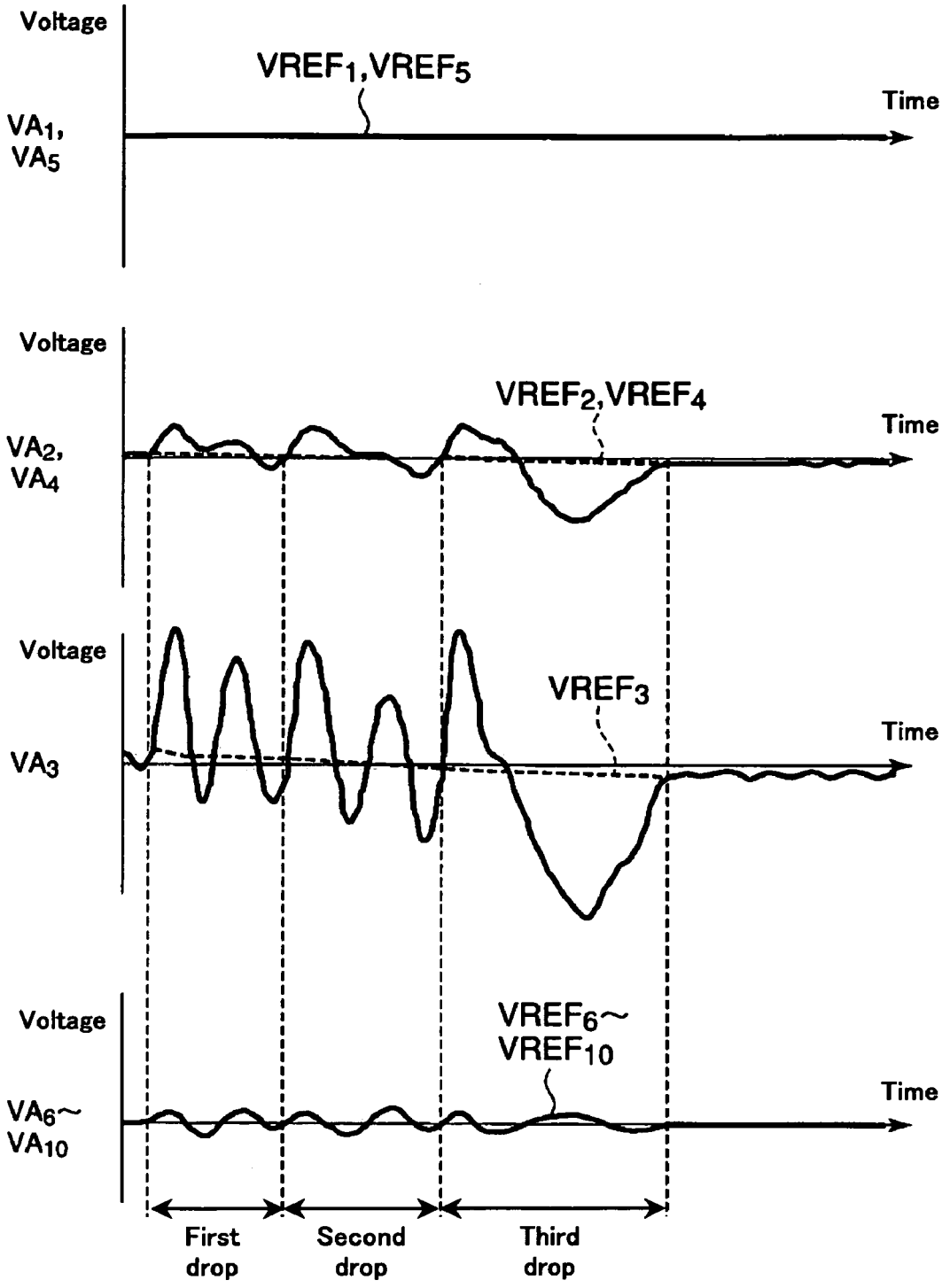
FIG. 15 illustrates drive signal waveforms each computed using a flow velocity of a hypothetical meniscus and response characteristic of the recording head according to the first embodiment.

When a waveform of the drive signal is calculated back from a hypothetical meniscus vibration using the Fourier transform, a divergence in the calculation result can be prevented by limiting the frequency range in the calculation to a range between zero and f max, which is the range of a frequency response of the ink jet recording head. To reproduce a hypothetical meniscus vibration at a sufficient accuracy from the drive signal having the waveform obtained by this calculation, it is desirable that "f max" cover the most part of the frequency component in flow velocity spectrum FU. In drive signal VA, the voltage amplitude and a period in which voltage variations appear depend on dimensions of the ink jet recording head, such as length L of the pressure chamber. Accordingly, it is desirable that the length L of the pressure chamber should be determined so that the period in which the voltage variations appear is within a predetermined range and the voltage amplitude becomes minimum. FIG. 15 displays drive signal VA ($VA_1$-$VA_{10}$) obtained in the manner as described above.

Figure 16:
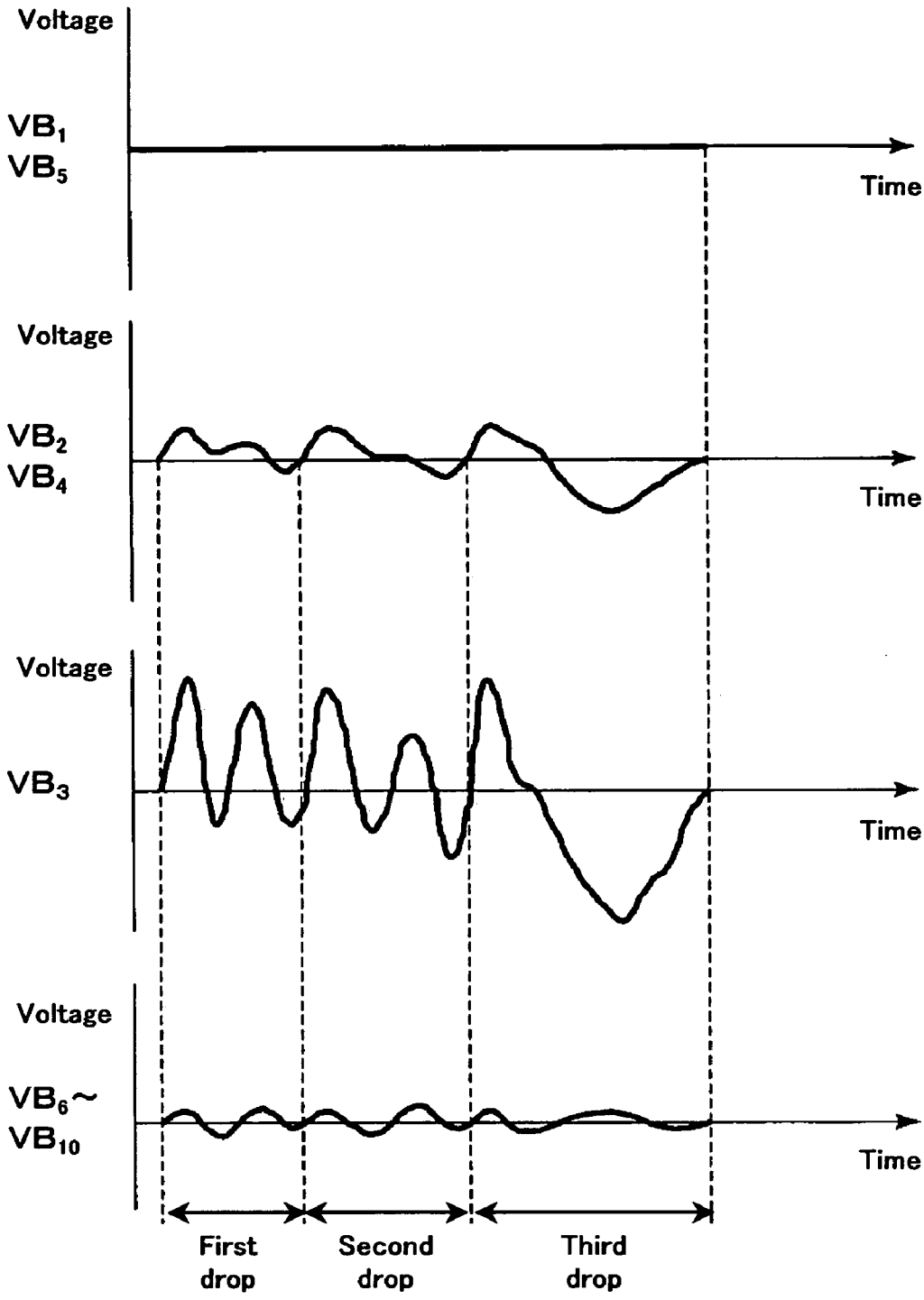
FIG. 16 illustrates drive signal waveforms compensated from the drive signal shown in FIG. 15.

The drive signal VA thus obtained can be used, as is, as a drive signal in the ink jet recording head. Instead of using drive signal VA, as is, however, drive signal VB ($VB_1$-$VB_{10}$) shown in FIG. 16 may be produced by calculating a difference between the drive signal VA and reference voltage VREF ($VREF_1$–$VREF_{10}$) depicted in a dotted line in FIG. 15 so that the time period of the drive signal from the first-droplet to the third droplet can be reduced. Thus, the drive period of the ink jet recording head can be reduced and thereby the printing speed can be improved.

Figure 17:
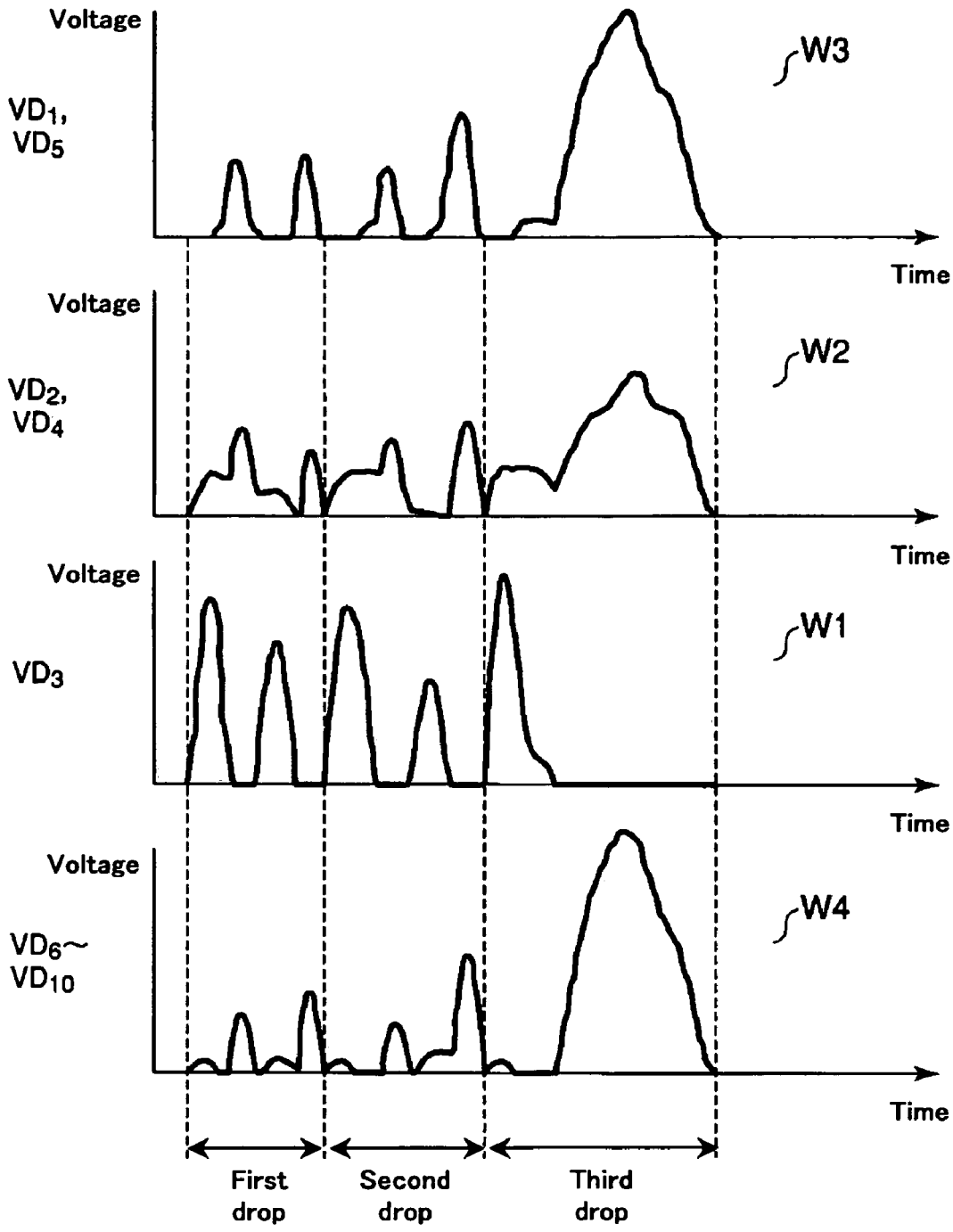
FIG. 17 illustrates drive signal waveforms modified from the drive signal waveforms shown in FIG. 16.

Drive signal VB thus obtained can be used also as is, as drive signal in the ink jet recording head. However, the voltage amplitude can be reduced by using drive signal VD calculated by the following formula (11). This reduction of the voltage amplitude of the drive signal can reduce the cost of a drive circuit of the recording head and hence an inexpensive ink jet recording apparatus can be provided. FIG. 17 displays drive signals $VD_1$-$VD_{10}$.

$$VD_{i,j} = Vb_{i,j} - \mathrm{MIN}\,[VB_{1,j}, VB_{2,j}, \ldots VB_{10,j}] \tag{11}$$

Figure 18:
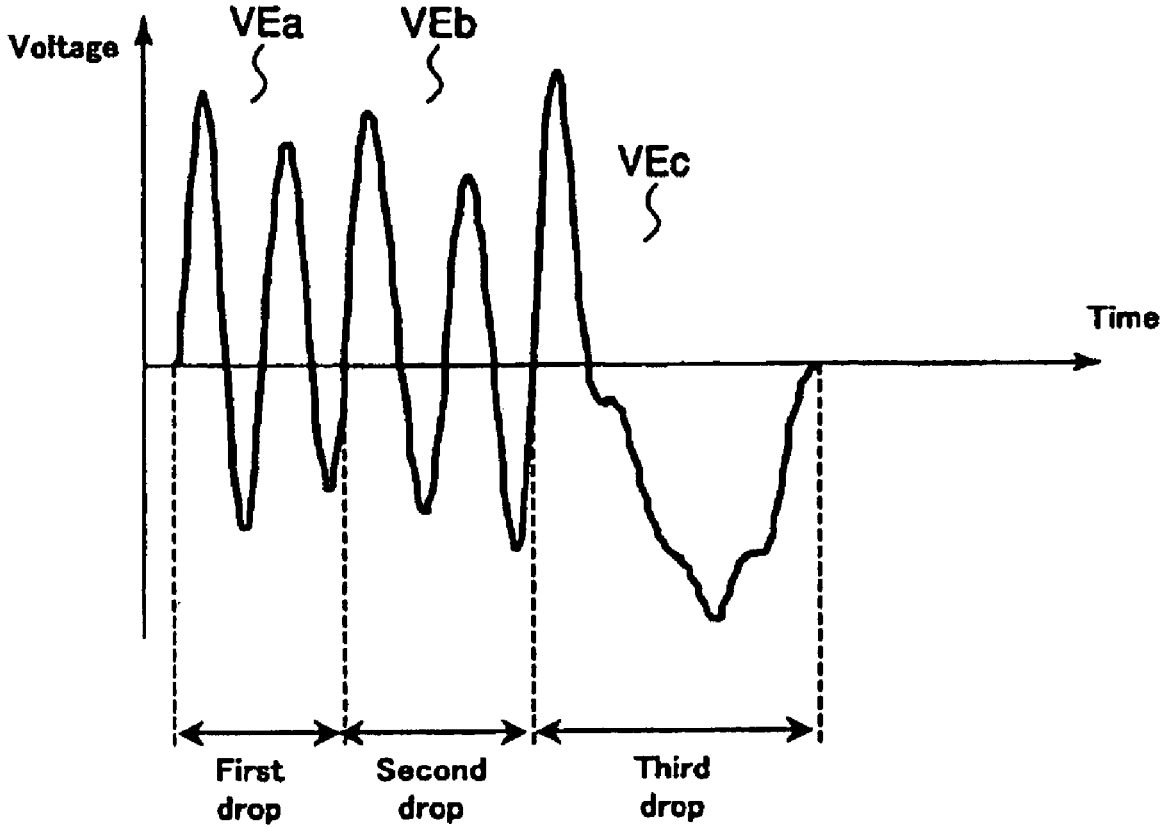
FIG. 18 illustrates a drive signal in the first embodiment that is applied to actuators driving a pressure chamber from which ink is ejected.

Herein, MIN [$VB_{1,j}$, $VB_{2,j}$, . . . $VB_{10,j}$] is a function representing a minimum value in values within the bracket. Drive signal $VD_3$ obtained in this calculation becomes drive signal W1, drive signal $VD_2$ or $VD_4$ becomes drive signal W2, drive signal $VD_1$ or $VD_5$ becomes drive signal W3, any one of drive signal $VD_6$ through $VD_{10}$ becomes drive signal W4. Thus, drive signals VEs applied to actuators 14*c* and 14*d*, which drive pressure chamber 9*c* from which ink is ejected, are calculated by ($VD_3$-$VD_2$). The drive signals thus obtained are shown in FIG. 18.

The above method of producing drive signals can be applied to actual production of an ink jet recording apparatus by following the procedure described below. First, a response characteristic R responsive to a drive signal of the ink jet recording head that is manufactured is to be measured, using a test drive signal such as a noise waveform or sine wave. Then, a waveform of drive signal is produced by computing formulas (4) through (10) based on the response characteristic and a predefined hypothetical meniscus vibration. Further, if needed, the waveforms of the drive signal are modified using formula (11) or others. At last, the waveforms thus obtained are stored in drive waveform memory 21 of the ink jet recording apparatus.

The hypothetical meniscus vibration will be described in detail in reference to FIGS. 12 and 13. Where ink is ejected so as to form one pixel by selecting a plurality of ink droplets having different sizes, if velocities of ink droplets largely differ by their sizes, difficulty arises. That is, if droplet ejection velocities are too low, landing positions accuracy lowers; or if the velocities are too high, performance of ink ejection becomes unstable. In general, the droplet velocity is roughly determined by a formula of "a/st," where "st" represents an "elapse time on ink ejection (a meniscus)" and "a" represents a "displacement of a meniscus," (on the ink ejection) (as in FIG. 12).

Specifically, FIG. 12 illustrates displacement $X_3$ of the hypothetical meniscus vibration in nozzle 10*c*, as an example in this embodiment, from which ink is ejected. Letting elapse times on ejections of the first drop, second drop, and third drop be $st_1$, $st_2$, $st_3$, respectively, and hypothetical meniscus displacements be a1, a2, and a3, respectively, the relationship among them is given as follows:

$$a1/st_1 \approx a2/st_2 \approx a3/st_3$$

By defining the hypothetical meniscus vibration so that a ratio between the elapse time on the ink ejection and amount of the hypothetical meniscus displacement is to be constant, ink droplets having different volumes can be ejected at nearly the same velocity.

In addition, the residual vibration after completing operation of ink ejection of each drop is made to become zero by providing at the end of hypothetical meniscus displacement of each drop a timing at which a displacement becomes zero and a time differential of displacement, i.e. "flow velocity" also becomes zero. Thus, for example, variation in droplet velocity at ejection of the second drop, which is caused depending on whether ejection of the first drop has been made immediately before it, can now be prevented and thus flying (ejection) velocities of the respective drops (having different volumes) can also be uniformed.

Furthermore, in FIG. 13 vibrating flow velocities $U_1$, $U_2$, $U_4$, and $U_5$ in nozzles 10*a*, 10*b*, 10*d*, and 10*e* from which no ink is to be ejected are seen to be −¼ of vibrating flow velocity $U_3$ in nozzle 10*c* from which ink is to be ejected. That is, it can be said that the hypothetical meniscus flow velocities depicted in FIG. 13 serve to deconcentrate vibrating flow velocities in adjacent ink nozzles 10*b* and 10*d*, which are caused accompanied by action of ink ejection from nozzle 10*c*, evenly towards no-ink-ejection nozzles 10*a*, 10*b*, 10*d*, and 10*e* including the adjacent nozzles. By thus defining hypothetical meniscus flow velocities and computing drive signal waveforms, in actual meniscuses, vibrating flow velocities generated accompanied by an action of ink ejection can be evenly deconcentrated to non-ink-ejection nozzles. This in turn means, because a magnitude of the vibrating flow velocity is proportional to that of the pressure vibration, that the hypothetical meniscus flow velocities depicted in FIG. 13 serve to deconcentrate pressure vibrations in adjacent pressure chambers 9*b* and 9*d*, which are produced accompanied by action of ink ejection from pressure chamber 9*c* evenly towards pressure chambers from which no ink is to be ejected. Since such pressure vibrations are caused by change of a capacity of a pressure chamber, it can be further said that the hypothetical meniscus flow velocities depicted in FIG. 13 cause capacities of no ink-ejecting pressure chambers 9*a*, 9*b*, 9*d*, and 9*e* to evenly vary. That is, by computing waveforms of drive signals using the hypothetical meniscus flow velocities depicted in FIG. 13 such drive signals that can make capacities of the no ink-ejecting pressure chambers evenly vary can be obtained.

A force that makes a meniscus protrude in a no ink-ejection nozzle is proportional to roughly a square of flow velocity amplitude in each nozzle. Accordingly, by deconcentrating vibrating flow velocity produced accompanied by an action of ink ejection towards no ink-ejection nozzles, forces that cause meniscus protrusions in over all nozzles of no ink-ejection can be minimized. Thus, by evenly dispersing a vibrating flow velocity, meniscus protrusion from a nozzle surface, variation in meniscus position caused after ink ejection, and variation in velocity of ink ejection can be desirably controlled, and thereby recording quality can be improved.

Figure 19:
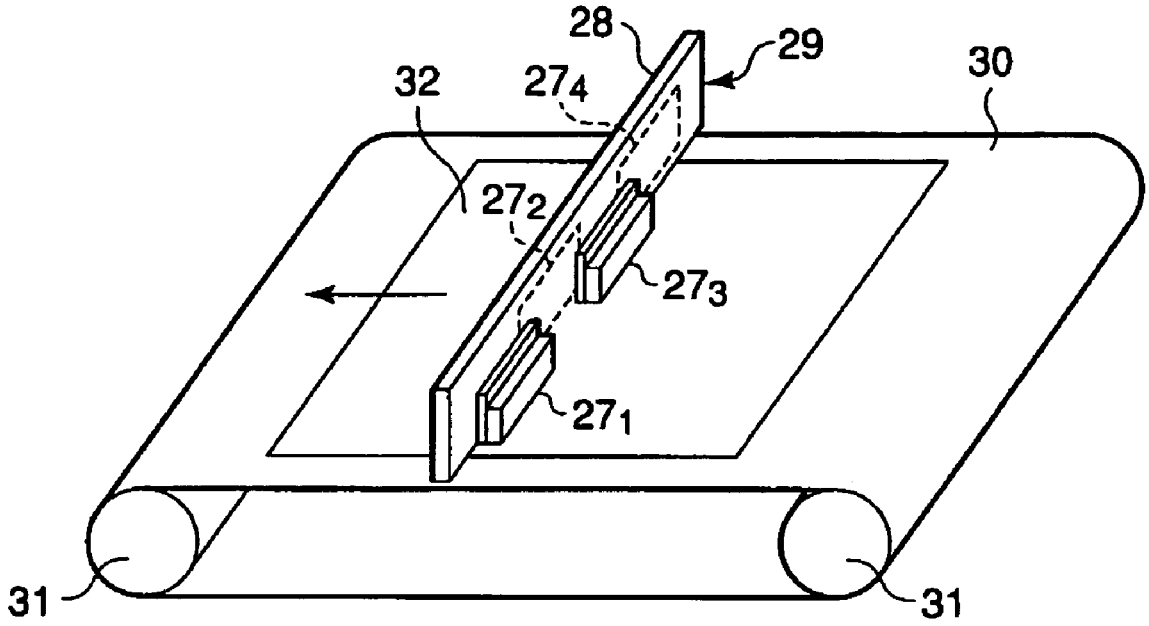
FIG. 19 is a perspective view illustrating appearance of principal parts of an ink jet recording apparatus according to the first embodiment.

FIG. 19 is a perspective view illustrating an exterior of the principle part of the ink jet recording apparatus to whose recording head the above-mentioned control method is implemented. This ink jet recording apparatus incorporates a line head 29 in which, for example, four recording heads $\mathbf{27}_1$, $\mathbf{27}_2$, $\mathbf{27}_3$, and $\mathbf{27}_4$ are disposed on the both sides of substrate 28 in staggered fashion.

Line head 29 is installed with a predetermined gap from a medium conveying belt 30. Medium conveying belt 30, which is driven by a belt drive roller 31 in an arrow direction, conveys a recording medium 32 such as a paper in contact with the surface of the belt. Printing is made such that, when recording medium 32 passes under line head 29, ink droplets are caused to be ejected from the respective recording head $\mathbf{27}_1$-$\mathbf{27}_4$ downwards and deposited on recording medium 32. To attract and keep in contact recording medium 32 to medium conveying belt 30, a known method, such as one that causes to suck the recording medium using static electricity or air flow, or one that presses ends of the recording medium can be used.

Recording by the respective recording head is made in a line on the recording medium by adjusting timing of ejecting ink droplets from nozzles of the pressure chambers in the respective ink jet recording heads $\mathbf{27}_1$-$\mathbf{27}_4$ of the line head 29.

Also, in this embodiment, the drive circuit was configured such that drive signal waveform memory 21 was provided for storing waveform information relative to drive signals ACT1-ACT5 that are applied to ink-ejecting pressure chamber 9 and waveform information relative to drive signal INA that is to be applied to non-ink-ejecting pressure chamber, and these drive signals are read from drive signal waveform memory 21 and selected by drive signal selecting means 24. The structure need not be limited to such a scheme.

Figure 20:
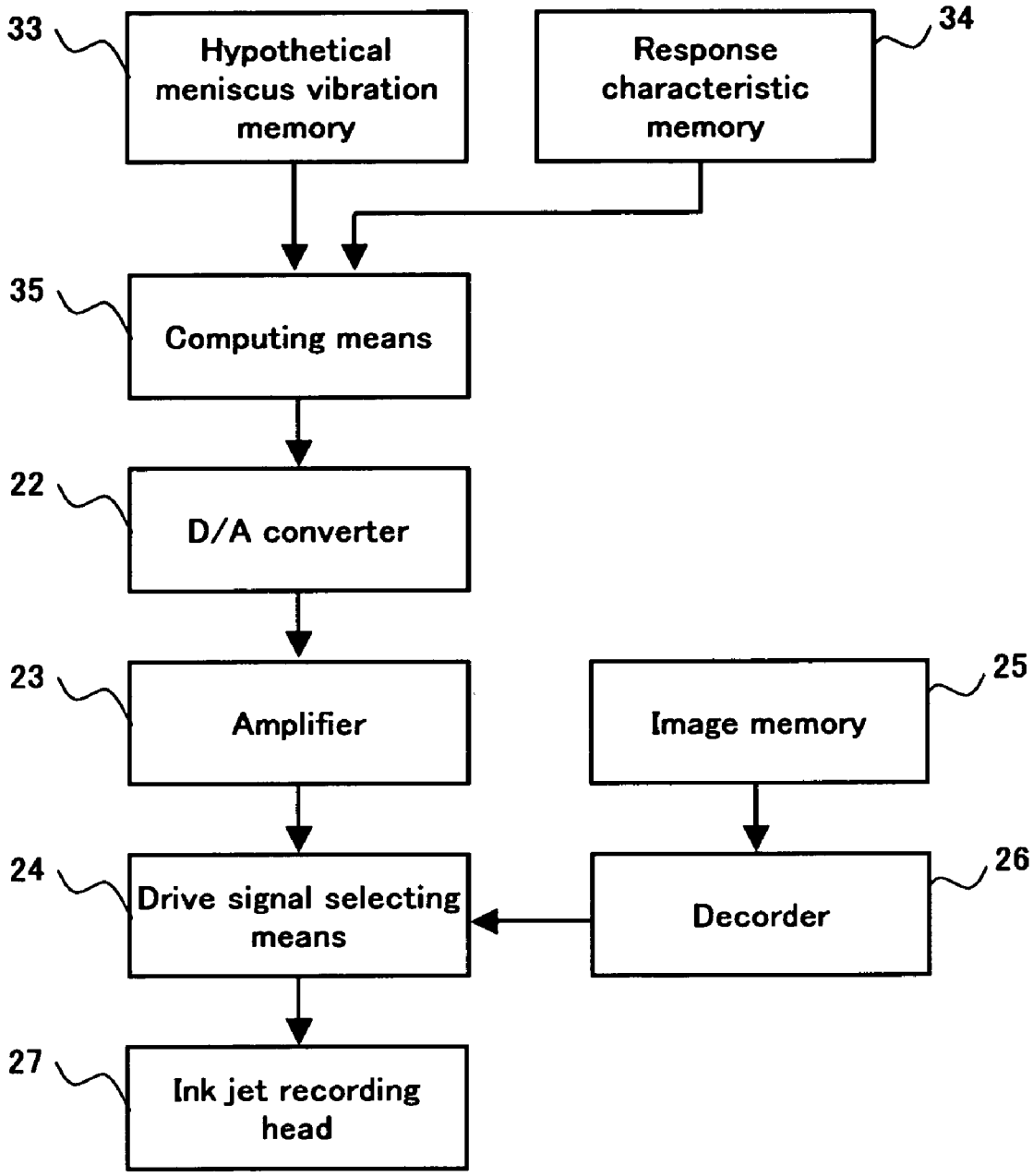
FIG. 20 is a functional block diagram of a drive circuit of an ink jet recording head according to the first embodiment of the present invention.

Alternatively, for example, an ink jet recording apparatus as illustrated in FIG. 20 can be contemplated, which comprises hypothetical meniscus vibration memory 33 for storing information on hypothetical meniscus vibrations, response characteristic memory 34 for storing information on response characteristic R, and computing means 35. In this ink jet recording apparatus, control for ink ejection can be made such that computing means 35 computes a hypothetical meniscus flow velocity U from a displacement of the hypothetical meniscus vibration in hypothetical meniscus vibration memory 33, a flow velocity spectrum FU from this hypothetical meniscus flow velocity U, a voltage spectrum FVA from this flow velocity spectrum FU and response characteristic R stored in response characteristic memory 34; drive signals W1, W2, W3, and W4 are obtained by computing formulas (10) and (11), then drive signals ACT1-ACT5 and INA are obtained from the resulted drive signals; lastly, these drive signals ACT1-ACT45 and INA are selected by drive signal selecting means 24.

To simplify such computations, it is desirable that, either the frequency response of the voltage waveform VA at more than f max be cut in computing means 35, or the frequency response of the hypothetical meniscus vibration at more than f max stored in hypothetical meniscus vibration memory 33 or the response characteristic at more than f max stored in response characteristic memory 34 be cut off prior to performing the computation.

The Second Embodiment

The following describes the second embodiment of the invention, in which a four-time divisional driving method is incorporated into an ink jet recording. Like parts as in the former embodiment bear like reference numbers, and the detailed descriptions therefore will be omitted.

Figure 21:
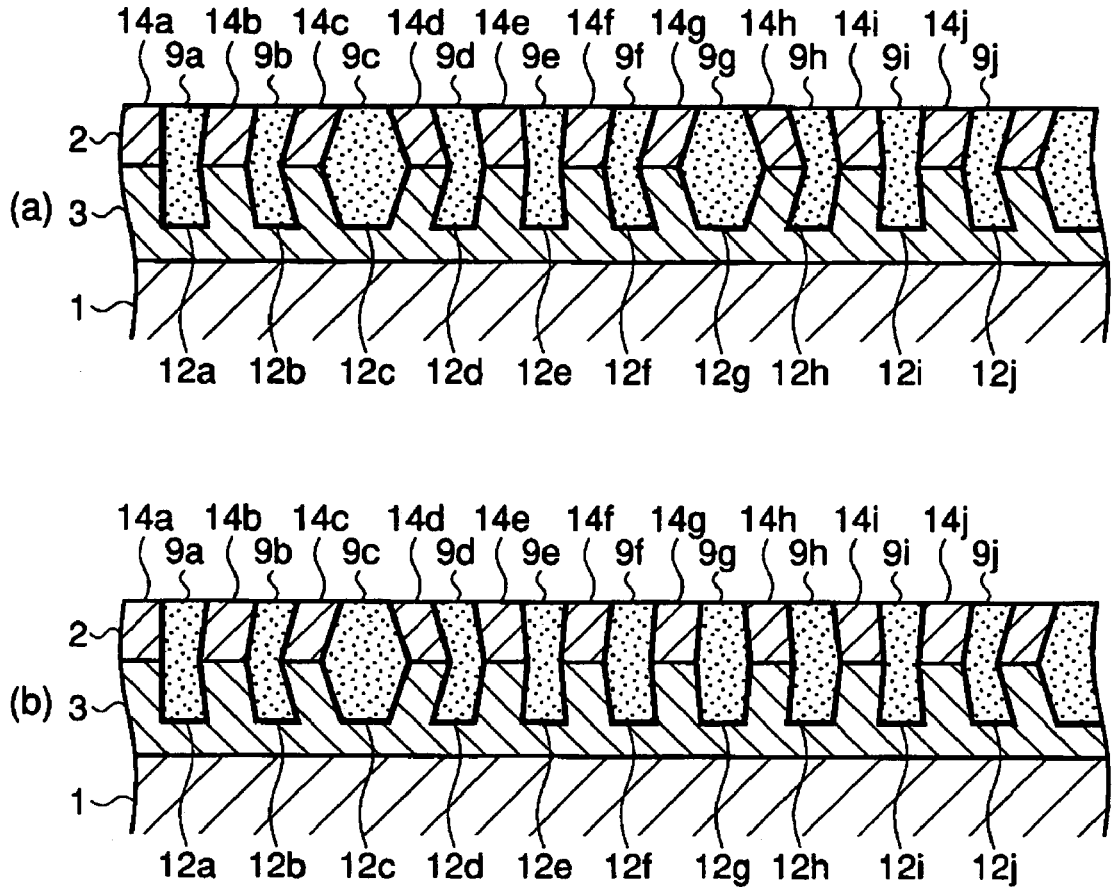
FIG. 21 is a transverse cross sectional view for illustrating operation of actuators in the ink jet recording head according to the second embodiment.

In this four time-divisional driving, for example, pressure chambers 9*c* and 9*g* among pressure chambers 9*a*-9*j* are to be driven at the ejection timing in the same operational cycle. When ink ejection is to be made from both chambers 9*c* and 9*g*, actuators 14*a*-14*j* are operated so as to deflect as illustrated in FIG. 21(*a*). If ink ejection is to be made from pressure chamber 9*c* but not from 9*g*, actuators 14*a*-14*j* are operated so as to deflect as in FIG. 21(*b*).

Figure 22:
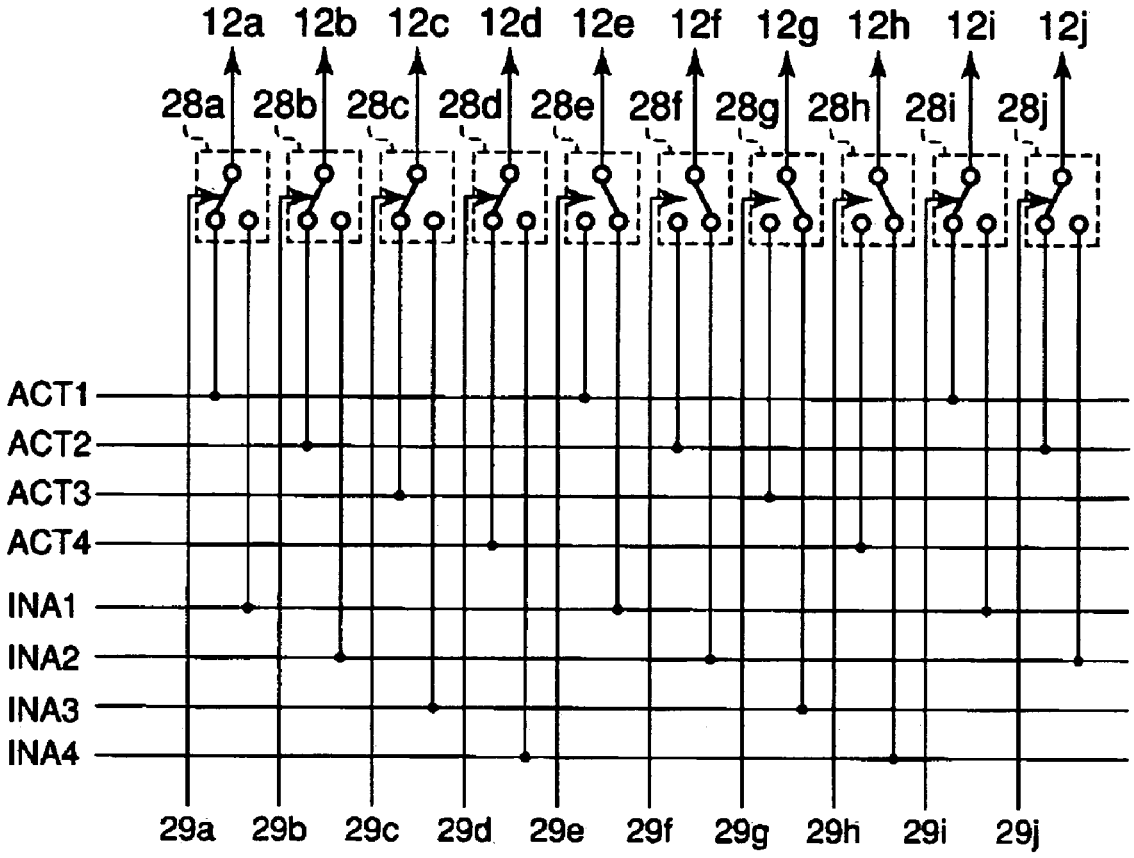
FIG. 22 is a circuit diagram of the drive signal selecting means according to the second embodiment.

A structure of the drive signal selecting means for achieving such operation control, which differs from the structure for performing five time-divisional driving, is shown in FIG. 22. In this drive signal selecting means, On/Off signals 29*a*-29*j* control analog switches 28*a*-28*j* to turn on or off, respectively. That is, when On/Off signals 29*a*-29*d* are turned on, drive signals ACT1-ACT4 inputted are selected by analog switches 28*a*-28*d* and led the signals to electrodes 12*a*-12*d* of ink jet recording head 27, respectively. When On/Off signals 29*a*-29*d* are turned off, drive signals INA1-INA4 inputted are selected and led to electrodes 12*a*-12*d* of ink jet recording head 27, respectively.

Similarly, when On/Off signals 29e-29h are turned on, drive signals ACT1-ACT4 inputted are selected by analog switches 28e-28h and led to electrodes 12e-12h of ink jet recording head 27, respectively. When On/Off signals 29e-29h are turned off, drive signals INA1-INA4 inputted are selected by analog switches 28e-28h and led to electrodes 12e-12h of ink jet recording head 27, respectively.

Also, when On/Off signals 29i, 29j . . . are turned on, drive signals ACT1, ACT2 . . . inputted are selected by analog switches 28i, 28j . . . and led to electrodes 12i, 12j . . . of ink jet recording head 27, respectively. When On/Off signals 29i, 29j . . . are turned off, drive signals INA1, INA2 . . . inputted are selected by analog switches 28i, 28j . . . and led to electrodes 12i, 12j . . . of ink jet recording head 27, respectively.

Drive signals ACT1-ACT4 correspond to the first through fourth cycle in four time-divisional driving, respectively. For example, at a certain timing if an ink droplet is desired to be ejected from pressure chamber 9c but not from pressure chamber 9g at the same operation timing, as shown in FIG. 21(b), ON/OFF signal 29c corresponding to pressure chamber 9c and three ON/OFF signals 29a, 29b, and 29d, which relate to two positions on one side and one opposing it (relative to pressure chamber 9c), are turned on, while ON/OFF signal 29g corresponding to pressure chamber 9g and three ON/OFF signals 29e, 29f, and 29h, which relate to two chambers on one side and one opposing it (the pressure chamber 9g), are turned off. That is, the ACT signals are applied to pressure chamber 9c from which ink ejection is intended and three chambers 9a, 9b, 9d including two on one side and one opposite the former 9c, and the INA signals are applied to pressure chambers 9g from which ink ejection is not made and three chambers 9e, 9f, 9h, including two on one side and one opposite to 9g.

Now, drive signals ACT1-ACT4 and INA1-INA4, which are supplied to the drive signal selecting means, will be described.

Figure 23:
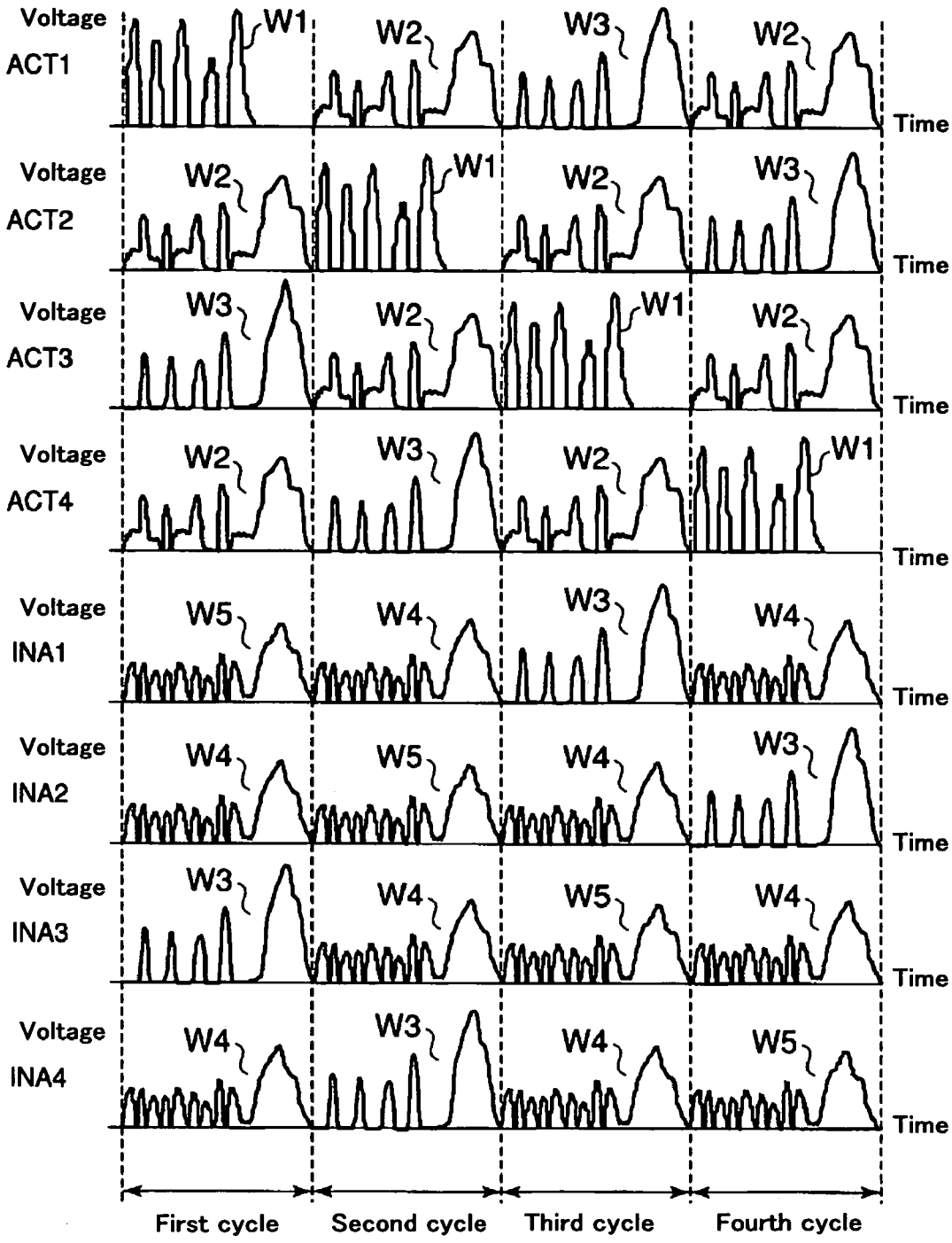
FIG. 23 shows drive signals inputted to the drive signal selecting means according to the second embodiment.

FIG. 23 depicts drive signals for ejecting ink, ACT1-ACT4, and drive signals for not ejecting ink, INA1-INA4, each in one printing period. Drive signals ACT1-ACT4 each contain three different types of drive signals W1, W2, and W3, and drive signals INA1-INA4 each contain three drive signals of W3, W4, and W5. The respective drive signals of ACT1-ACT4 shift from one to another by one phase of a time division within the one printing period in the four time-divisional driving. In operation, for example, if ink is to be ejected from pressure chamber 9c, ON/OFF signals 29a-29d are turned on at the third cycle so that W3 is supplied to pressure chamber 9a, W2 to pressure chambers 9b and 9d, and W1 to pressure chamber 9c.

Figure 24:
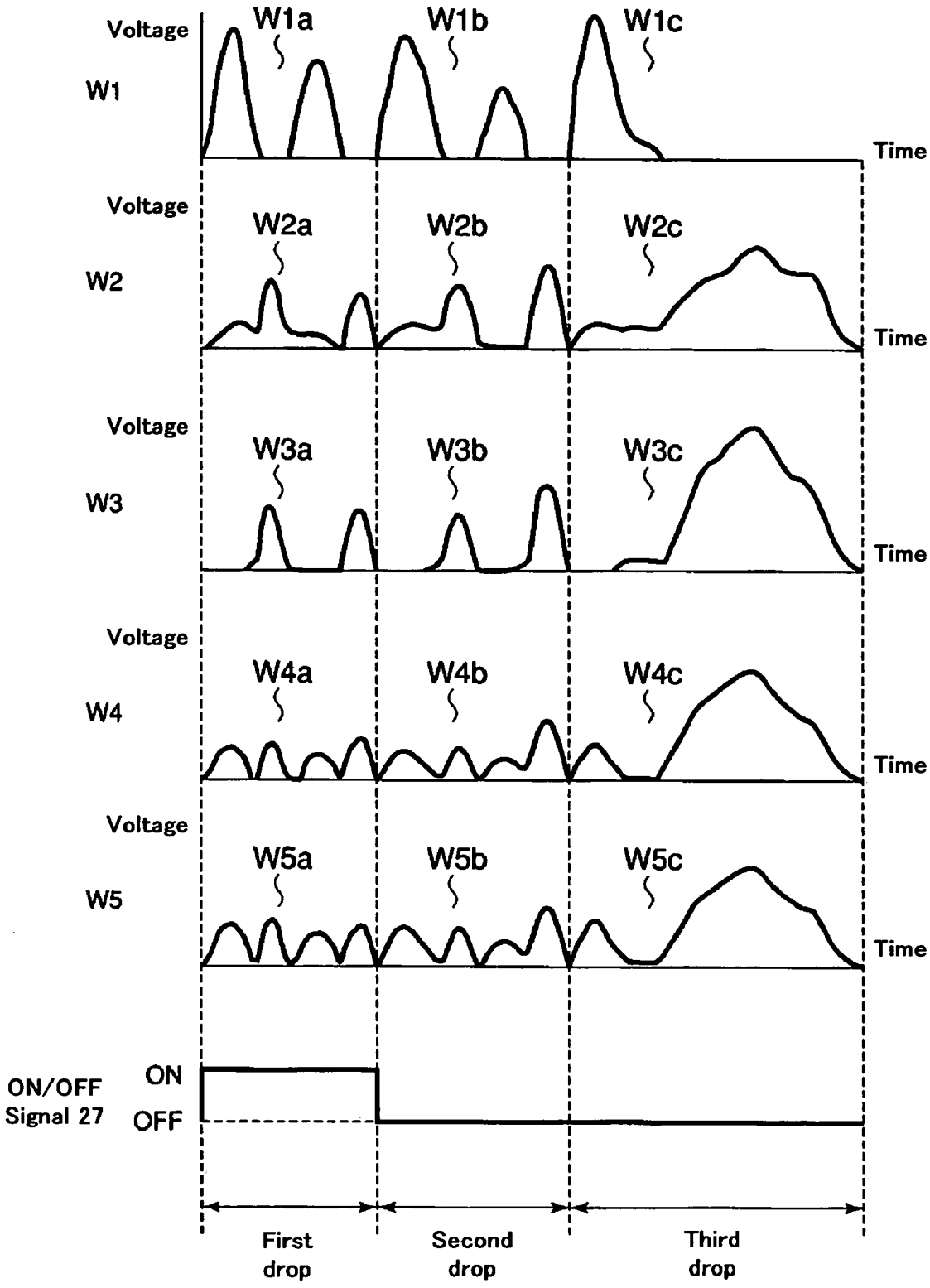
FIG. 24 illustrates individual drive signals that constitute the drive signals inputted to the drive signal selecting means according to the second embodiment.

Next, drive signals W1 through W5 will be described. As shown in FIG. 24, drive signals W1, W2, W3, W4 and W5 are constituted by drive signals W1a, W2a, W3a, W4a and W5a, each residing at the first stage of one division cycle where ejection of the first drop having a volume of 6 pico-liters takes place, W1b, W2b, W3b, W4b and W5b, each residing at the second stage of one division cycle where ejection of the second drop having a volume of 12 pico-liters takes place; and W1c, W2c, W3c, W4c and W5c, each residing at the third stage of one division cycle where ejection of the third drop having a volume of 24 pico-liters takes place.

For example, if the first drop is to be ejected from pressure chamber 9c but not from pressure chamber 9g, ON/OFF signals 29a-29d are turned on at the first-drop stage within the third cycle, and ON/OFF signals 29e-29h are turned off at the same stage. Thereby, at the same stage of the cycle, drive signal W1a is applied to electrode 12c, drive signal W2a is applied to electrodes 12b and 12d, and drive signal W3a is applied to electrodes 12a and 12e, drive signal W4a is applied to electrodes 12f and 12h, and drive signal W5a is applied to electrode 12g.

As a result, as illustrated in FIG. 21(b), actuators 14c and 14d are driven to largely deflect by virtue of potential difference between drive signals W1a and W2a so that an ink droplet of 6 pico liters is ejected from pressure chamber 9c; actuators 14b and 14e are caused to deflect by potential difference between drive signals W2a and W3a so as to deconcentrate pressure vibration produced in pressure chambers 9b and 9d towards pressure chambers 9a and 9e; and actuator 14f is caused to deflect by potential difference between drive signals W3a and W4a in the similar manner to the case that the first drop is ejected from pressure chamber 9g. Therefore, the magnitude of a pressure vibration produced within pressure chamber 9e accompanied by action of ejecting ink from pressure chamber 9c becomes the same as that in the case ink ejection is made from pressure chamber 9g. Thus, the related cross talk can be substantially zeroed.

Actuators 14g and 14h are caused to deflect by potential difference between drive signals W4a and W5a so as to disperse a pressure vibration produced within pressure chamber 9g. Thus, pressure vibrations generated in pressure chambers 9f-9h are significantly reduced and hence adverse affect to printing quality due to meniscus protrusions in no ink-ejecting nozzles 10f-10h can be alleviated.

Figure 25:
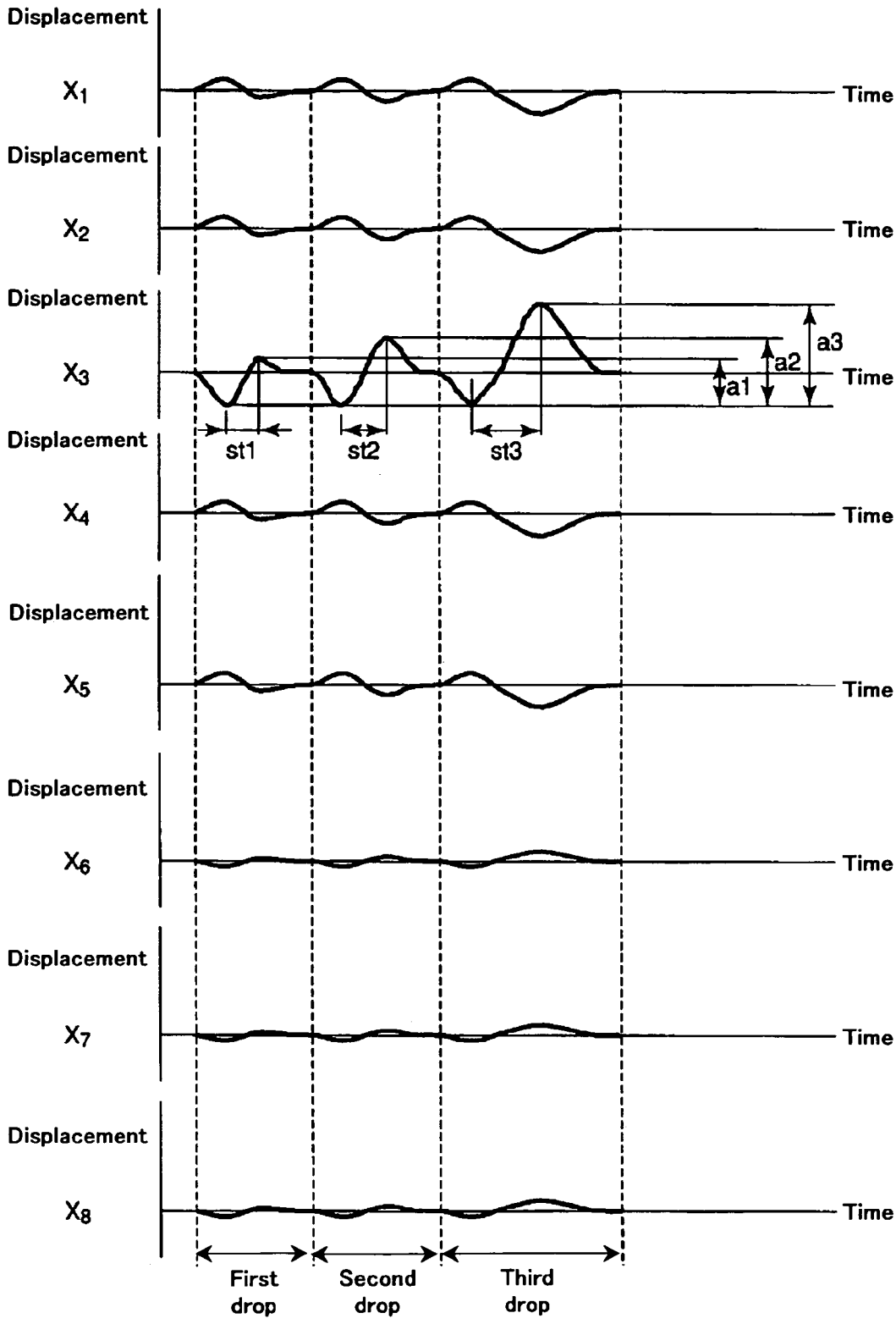
FIG. 25 shows a hypothetical meniscus vibration in the second embodiment.
Figure 27:
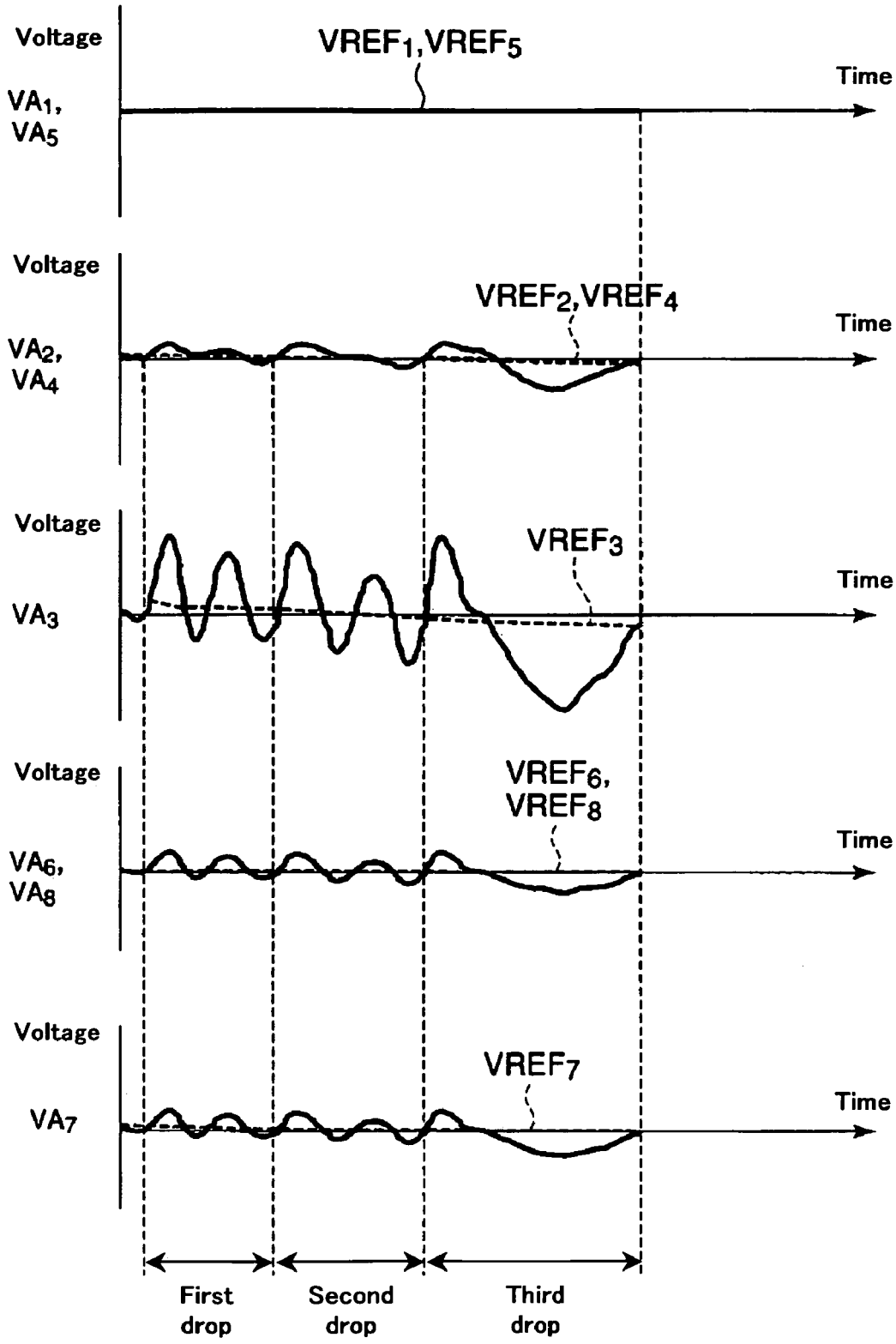
FIG. 27 illustrates drive signal waveforms each computed using a flow velocity of a hypothetical meniscus and response characteristic of the recording head according to the second embodiment.
Figure 28:
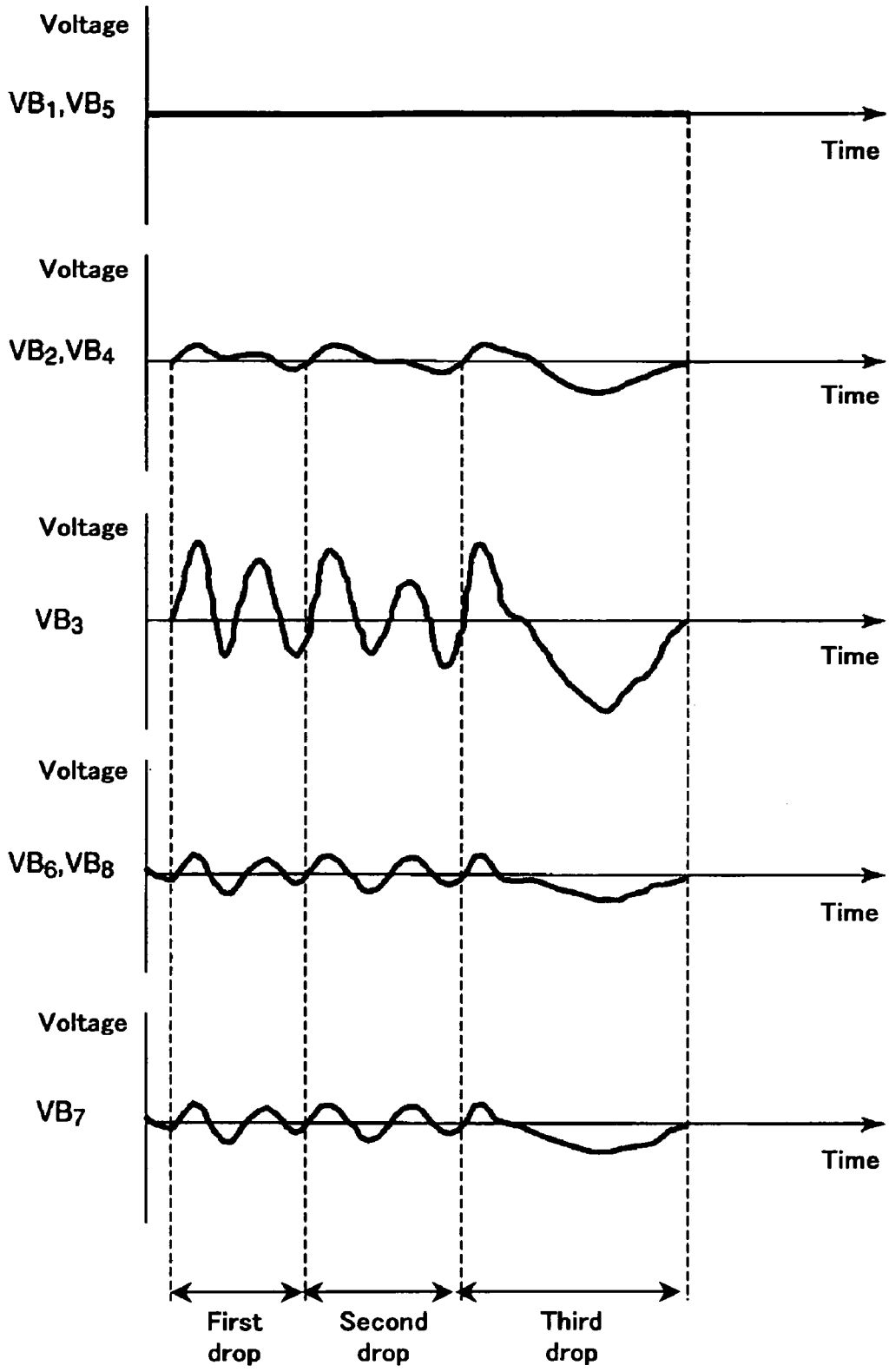
FIG. 28 illustrates drive signal waveforms compensated from the drive signal shown in FIG. 27 according to the second embodiment.
Figure 29:
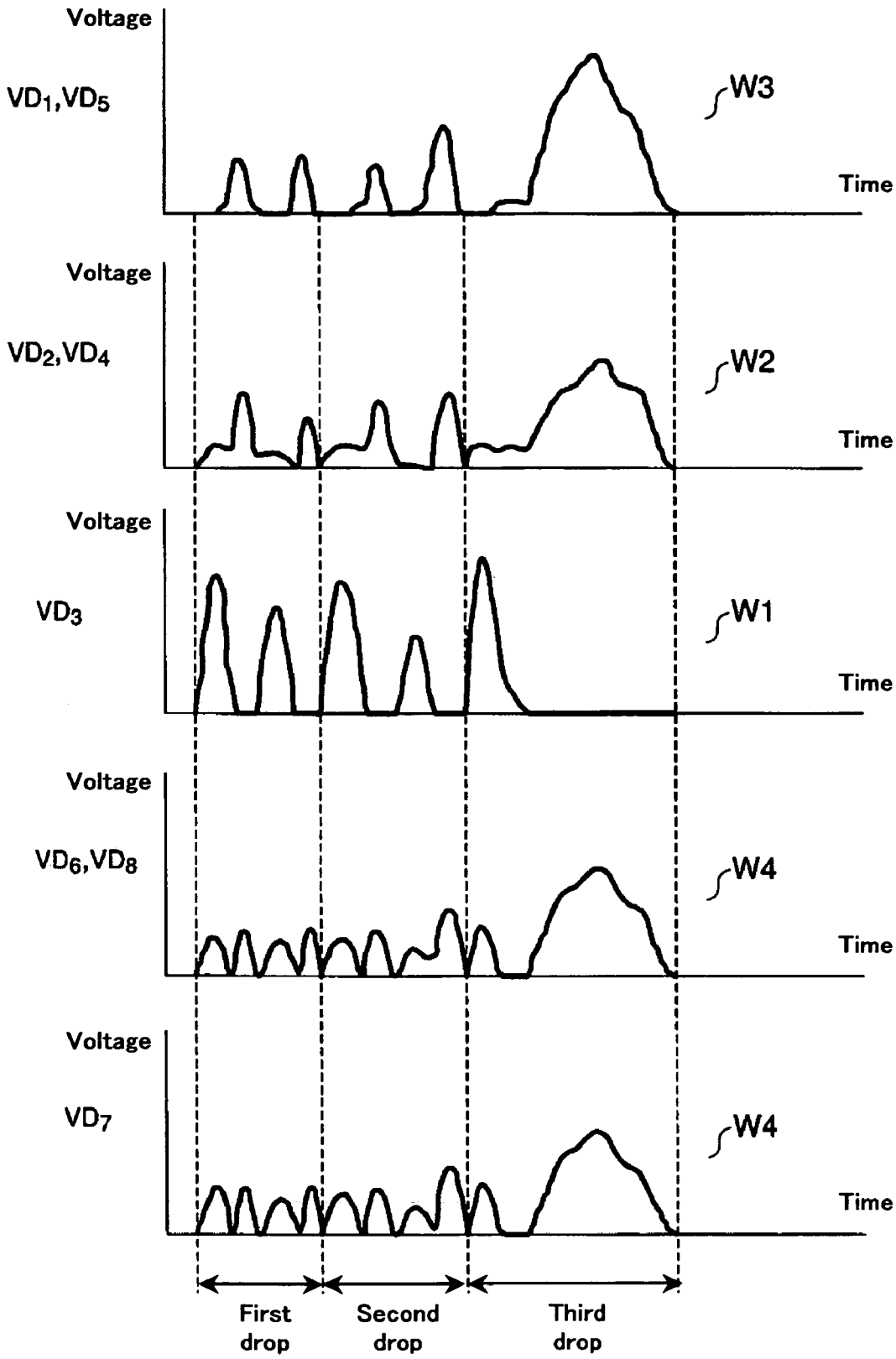
FIG. 29 illustrates drive signal waveforms modified from the drive signal waveforms shown in FIG. 28 according to the second embodiment.

Method of generating drive signals in the second embodiment is the same as in the first embodiment. That is, as shown in hypothetical meniscus displacements in FIG. 25, for example, if the first through third drops are made to be ejected from pressure chamber 9c but none from pressure chamber 9g, hypothetical meniscus displacements in nozzles 10a-10h become $X_1$-$X_8$, respectively. Hypothetical meniscus velocities U in nozzles 10a-10h in this embodiment are depicted in FIG. 26; drive signals VA are depicted in FIG. 27; drive signals VB are depicted in FIG. 28; and drive signals VD are depicted in FIG. 29.

Figure 26:
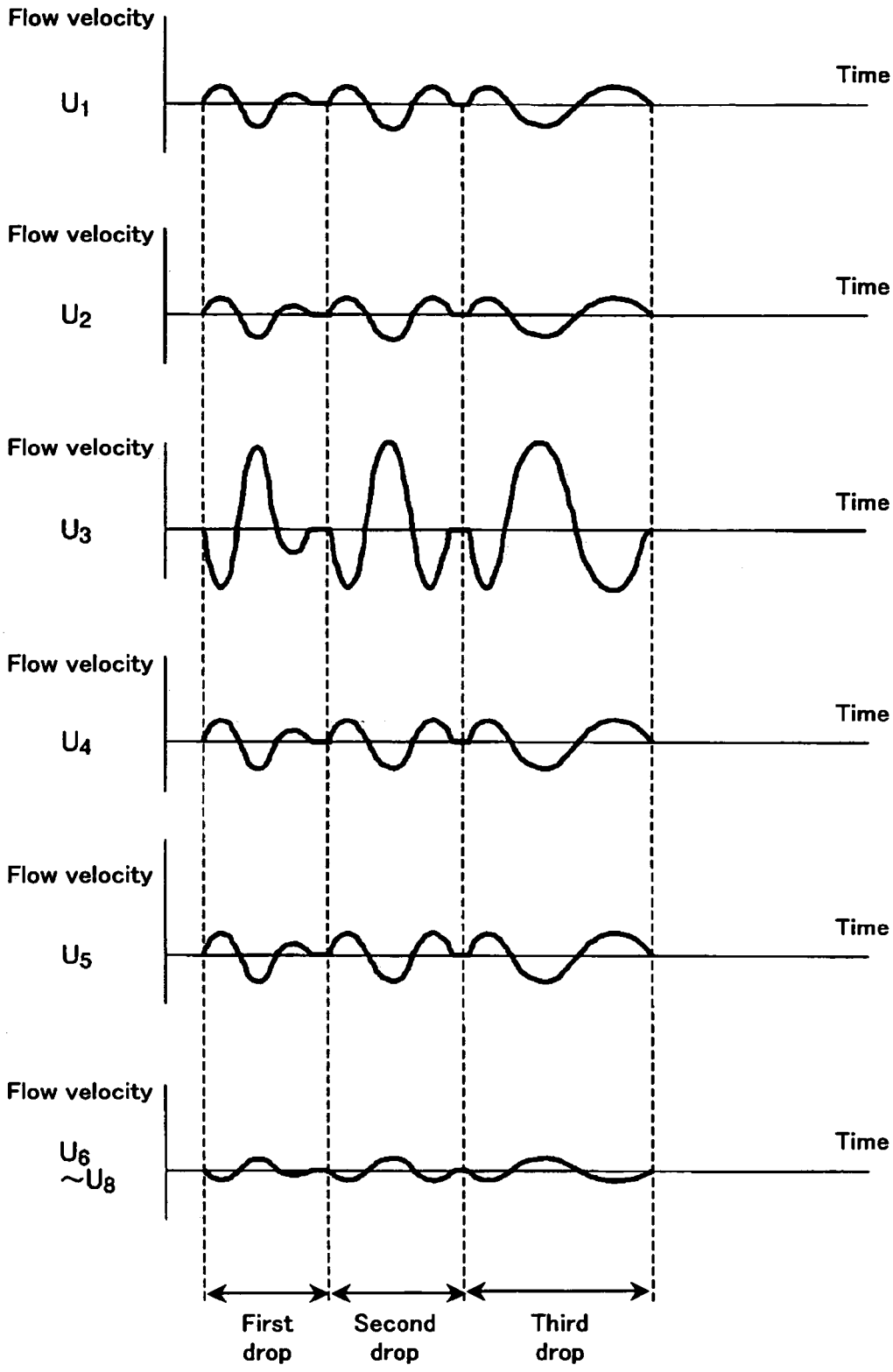
FIG. 26 shows an example of hypothetical meniscus flow velocity in the second embodiment.

In FIG. 26, vibrating flow velocities $U_1$, $U_2$, and $U_4$ of non ink-ejecting nozzles 10a, 10b, and 10d are —⅓ of the vibrating flow velocity of ink-ejecting nozzle 10c. In such a structure, in the case that ink-ejection is made concurrently from nozzles 10c and 10 g, as shown in FIG. 21(a), vibrating flow velocities $U_1$, $U_2$, $U_4$, $U_5$, $U_6$, $U_8$ of non ink-ejecting nozzles 10a, 10b, 10d, 10e, 10f, and 10h become —⅓ of the vibrating flow velocities $U_3$ and $U_7$ of ink-ejecting nozzles 10c and 10g. Thus, vibrating flow velocities $U_2$, $U_4$, $U_6$, $U_8$ of neighboring nozzles 10b, 10d, 10f, 10h generated accompanied by ink ejection from nozzles 10c and 10g can be evenly deconcentrated to non ink-ejecting nozzles 10a, 10b, 10d, 10e, 10f, and 10h. By thus defining hypothetical meniscus flow velocities and computing drive signal waveforms, in actual meniscuses, vibrating flow velocities generated accompanied by an action of ink ejection can be evenly deconcentrated to non-ink-ejection nozzles.

Figure 30:
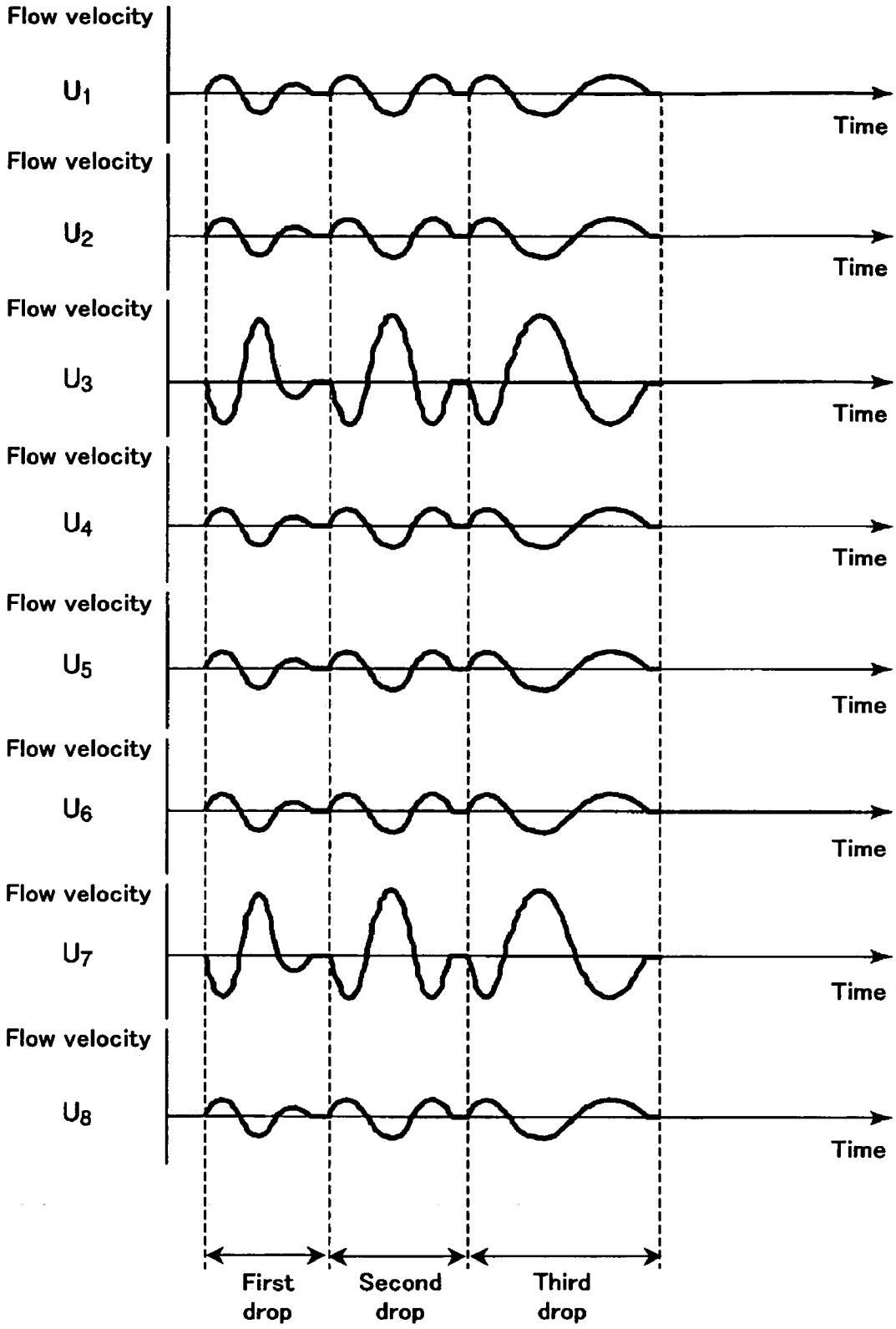
FIG. 30 shows another example of hypothetical meniscus flow velocity according to the second embodiment.

Since a magnitude of the vibrating flow velocity is proportional to that of a pressure vibration, pressure vibrations within the adjacent pressure chambers 9b, 9d, 9f, 9h generated being accompanied by actions of the ink-ejection from pressure chambers 9c and 9g that are driven to do so can be evenly deconcentrated towards non ink-ejecting nozzles. Furthermore, because such a pressure vibration is generated by change of volume of a pressure chamber, it can be said that hypothetical vibrating flow velocities of meniscuses as depicted in FIG. 30 can evenly vary volumes of non ink-ejecting pressure chambers 9a, 9b, 9d, 9e, 9f, and 9h. That is to say, by computing waveforms of respective drive signals using hypothetical vibrating flow velocities of individual meniscuses shown in FIG. 30, corresponding drive signals that evenly vary volumes of non ink-ejecting nozzles can be obtained.

In non-ink-ejecting nozzles, the magnitude of a force that causes to protrude a meniscus is nearly proportional to a square value of flow velocity in each nozzle. Therefore, by evenly deconcentrating vibrating flow velocity produced being accompanied by action of ink ejection to non ink-ejecting nozzles, total forces causing meniscus protrusions in all non ink-ejecting nozzles can be minimized.

Figure 31:
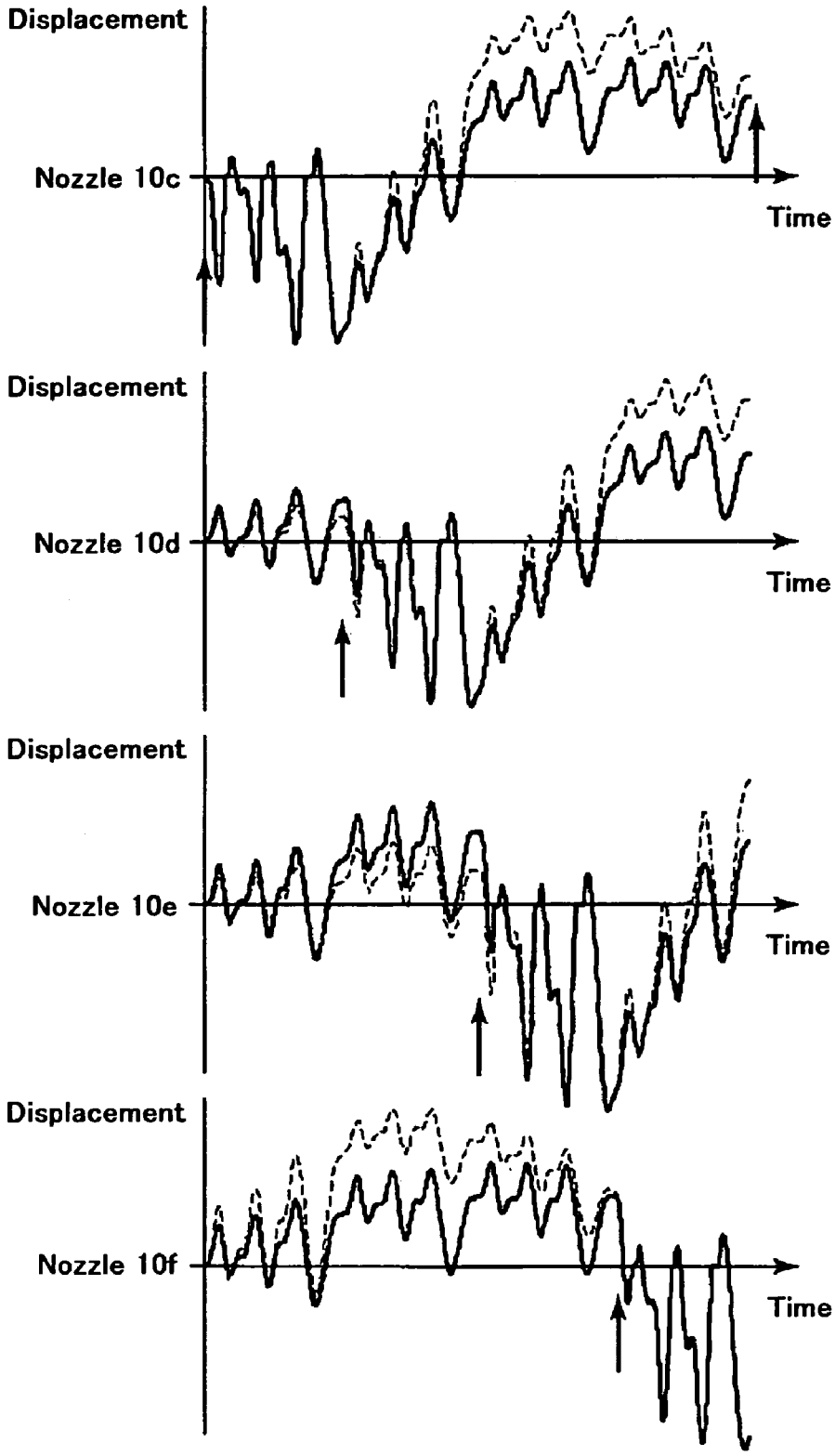
FIG. 31 illustrates meniscus displacements in some nozzles according to the second embodiment in comparison with conventional ones.

Shown in FIG. 31 is a result of simulation for numerical analysis of meniscus displacements in nozzles 10*c*-10*f* in the assumption that inks are ejected from both pressure chambers 9*c* and 9*g*, followed by ink ejection from pressure chambers 9*d* and 9*h*, and from 9*e* and 9*i*, then from 9*f* and 9*j* sequentially, ink ejection from each pair of pressure chambers being made concurrently. In the FIGURE, solid lines indicate results in this embodiment wherein volumes in non ink-ejecting pressure chambers have been made to evenly vary. Dashed lines illustrate cases where volumes in non ink-ejecting pressure chambers have been made to unevenly vary as seen in conventional methods. A ratio of volumes where the chamber volumes were unevenly varied were set to 1/4:1/4:1/2. Arrows in the FIGURES point start timings of ink ejection in the respective nozzles.

FIG. 31 illustrates a meniscus displacement within nozzle 10*c* in the cases that volumes of the respective non-ink-ejecting pressure chambers are made to evenly vary (shown in solid lines) and the same pressure chambers are made to unevenly vary. From this FIGURE, it can be seen that an amount of the meniscus protrusion occurred at the first ink ejection is more suppressed than that shown in a dashed line. Thus, this embodiment has showed a beneficial effect of improving printing quality by alleviating dropping of velocity of an ink droplet ejected by the action of the second ink ejection.

The above descriptions have been made in embodiments incorporating four and five time-divisional driving modes. However, applications in six or more time-divisional driving modes can be made as well without restricting the operation mode to the above.

Numerous modifications and variations of the present invention are possible in light of the above teachings. It is therefore to be understood that, within the scope of the appended claims, the present invention can be practiced in a manner other than as specifically described therein.

What is claimed is:

1. An ink jet recording apparatus, comprising:

an ink jet recording head, comprising:

a plurality of nozzles from each of which ink is ejected;

a plurality of pressure chambers communicating with the respective nozzles;

ink supplying means for supplying ink to the respective pressure chambers;

a plurality, of electrodes provided relative to the respective pressure chambers; and actuators each of which forms a side wall isolating the respective pressure chambers and is caused to deflect so as to vary a volume of the pressure chamber according to drive signals; and drive signal generating means for supplying the drive signals driving the pressure chambers to the electrodes relative to the respective pressure chambers, wherein said drive signal generating means generates drive signals for causing one of N serially arranged pressure chambers to eject ink therefrom, and for substantially evenly varying amplitudes of meniscus flow velocities within nozzles communicating with the remainder of the N pressure chambers, by deconcentrating pressure vibrations of ink produced in surrounding pressure chambers, formed next to and on both sides of the pressure chamber to eject ink, toward pressure chambers adjacent to each of the surrounding pressure chambers, with N being four or more.

2. The ink jet recording apparatus according to claim 1, wherein said drive signals are created based on waveforms computed from a result of measurements of response characteristics of meniscus vibrating flow velocities in response to a drive signal of the ink jet recording head and previously defined hypothetical meniscus flow velocities, and wherein the hypothetical meniscus flow velocities include a hypothetical meniscus flow velocity relative to a nozzle from which ink is made to be ejected and hypothetical meniscus flow velocities respectively relative to a plurality of nozzles from which ink is not to be ejected, the latter hypothetical meniscus flow velocities having mutually substantially uniform amplitudes.

3. The ink jet recording apparatus according to claim 2, wherein said computation of waveforms includes a process of computing a voltage vector {FVA} by $\{R\}^{-1}$. {FU} and subsequent Fourier inverse transforming of the voltage vector {FVA}, where a vector of hypothetical meniscus flow velocities in a plurality of nozzles is defined as {U}, a flow velocity vector as the result of the Fourier transform of the vector {U} as {FU}, and a matrix of a frequency response characteristic of the meniscus vibrating flow velocities in the respective nozzles in response to a drive signal of the ink jet recording-head as {R}.

4. The ink jet recording apparatus according to claim 3, wherein said computation is performed only in a frequency range equal to or lower than a specified frequency.

5. An ink jet recording apparatus, comprising:

an ink jet recording head, comprising:

a plurality of nozzles from each of which ink is ejected;

a plurality of pressure chambers communicating with the respective nozzles;

ink supplying means for supplying ink to the respective pressure chambers;

a plurality of electrodes provided relative to the respective pressure chambers; and actuators each of which forms a side wall isolating the respective pressure chambers and is caused to deflect so as to vary a volume of the pressure chamber according to drive signals; and drive signal generator configured to supply the drive signals driving the pressure chambers to the electrodes relative to the respective pressure chambers, wherein said drive signal generator is configured to generate drive signals for causing one of N serially arranged pressure chambers to eject ink therefrom, and configured to substantially evenly vary amplitudes of meniscus flow velocities within nozzles communicating with the remainder of the N pressure chambers, by deconcentrating pressure vibrations of ink produced in surrounding pressure chambers, formed next to and on both sides of the pressure chamber to eject ink, toward pressure chambers adjacent to each of the surrounding pressure chambers, with N being four or more.

6. The ink jet recording apparatus according to claim 5, wherein said drive signals are created based on waveforms computed from a result of measurements of response characteristics of meniscus vibrating flow velocities in response to a drive signal of the ink jet recording head and previously defined hypothetical meniscus flow velocities, and wherein the hypothetical meniscus flow velocities include a hypothetical meniscus flow velocity relative to a nozzle from which ink is made to be ejected and hypothetical meniscus flow velocities respectively relative to a plurality of nozzles from which ink is not to be ejected, the latter hypothetical meniscus flow velocities having mutually substantially uniform amplitudes.

7. The ink jet recording apparatus according to claim 6, wherein said computation of waveforms includes a process of computing a voltage vector {FVA} by $\{R\}^{-1}$ {FU} and subsequent Fourier inverse transforming of the voltage vector {FVA}, where a vector of hypothetical meniscus flow velocities in a plurality of nozzles is defined as {U}, a flow velocity vector as the result of the Fourier transform of the vector {U} as {FU}, and a matrix of a frequency response characteristic of the meniscus vibrating flow velocities in the respective nozzles in response to a drive signal of the ink jet recording head as {R}.

8. The ink jet recording apparatus according to claim 7, wherein said computation is performed only in a frequency range equal to or lower than a specified frequency.

9. An ink jet recording method, comprising:

arranging an ink jet recording head with a predetermined gap from a recording medium, providing the ink jet recording head with a plurality of nozzles from each of which ink is ejected, a plurality of pressure chambers communicating with the respective nozzles, ink supplying means for supplying ink to the respective pressure chambers, a plurality of electrodes provided relative to the respective pressure chambers and actuators each of which forms a side wall isolating the respective pressure chambers and is caused to deflect so as to vary a volume of the pressure chamber according to drive signals;

supplying the drive signals driving the pressure chambers to the electrodes relative to the respective pressure chambers, causing one of N serially arranged pressure chambers to eject ink therefrom; and substantially evenly varying amplitudes of meniscus flow velocities within nozzles communicating with the remainder of the N pressure chambers, by deconcentrating pressure vibrations of ink produced in surrounding pressure chambers, formed next to and on both sides of the pressure chamber to eject ink, toward pressure chambers adjacent to each of the surrounding pressure chambers, with N being four or more.

10. The ink jet recording method according to claim 9, further comprising:

creating the drive signals based on waveforms computed from a result of measurements of response characteristics of meniscus vibrating flow velocities in response to a drive signal of the ink jet recording head and previously defined hypothetical meniscus flow velocities, and including in the hypothetical meniscus flow velocities, a hypothetical meniscus flow velocity relative to a nozzle from which ink is made to be ejected and hypothetical meniscus flow velocities respectively relative to a plurality of nozzles from which ink is not to be ejected, the latter hypothetical meniscus flow velocities having mutually substantially uniform amplitudes.

11. The ink jet recording method according to claim 10, further comprising including a process of computing a voltage vector {FVA} by $\{R\}^{-1}$ {FU} and subsequent Fourier inverse transforming of the voltage vector {FVA}, where a vector of hypothetical meniscus flow velocities in a plurality of nozzles is defined as {U}, a flow velocity vector as the result of the Fourier transform of the vector {U} as {Fu}, and a matrix of a frequency response characteristic of the meniscus vibrating flow velocities in the respective nozzles in response to a drive signal of the ink jet recording head as {R}.

12. The ink jet recording method according to claim 11, further comprising forming the computation only in a frequency range equal to or lower than a specified frequency.

* * * * *